US008770730B2

(12) United States Patent
Nanjo et al.

(10) Patent No.: US 8,770,730 B2
(45) Date of Patent: Jul. 8, 2014

(54) LIQUID CONTAINER AND APPARATUS IN WHICH LIQUID CONTAINER IS MOUNTABLE

(71) Applicant: Canon Kabushiki Kaisha, Tokyo (JP)

(72) Inventors: Tatsuo Nanjo, Kawasaki (JP); Yasuo Kotaki, Yokohama (JP); Hitoshi Takada, Yokohama (JP); Koichi Kubo, Yokohama (JP); Hideki Ogura, Yokohama (JP); Hironori Murakami, Tokyo (JP); Takeho Miyashita, Machida (JP); Hideo Fukazawa, Chigasaki (JP); Eiichi Adachi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/767,353

(22) Filed: Feb. 14, 2013

(65) Prior Publication Data

US 2013/0222491 A1 Aug. 29, 2013

(30) Foreign Application Priority Data

Feb. 23, 2012 (JP) ..... 2012-037657
Jan. 23, 2013 (JP) ..... 2013-010367

(51) Int. Cl.
*B41J 2/175* (2006.01)

(52) U.S. Cl.
USPC ..... 347/86; 347/85

(58) Field of Classification Search
USPC ..... 347/84, 85, 86
See application file for complete search history.

(56) References Cited

U.S. PATENT DOCUMENTS

| | | | | |
|---|---|---|---|---|
| 4,760,409 | A | 7/1988 | Kiyohara et al. | 346/140 R |
| 5,172,821 | A | 12/1992 | Knopf | 215/286 |
| 6,474,797 | B2 | 11/2002 | Kurata et al. | 347/85 |
| 6,505,923 | B1 * | 1/2003 | Yamamoto et al. | 347/85 |
| 6,742,872 | B2 | 6/2004 | Fukazawa et al. | 347/50 |
| 6,824,258 | B2 | 11/2004 | Yamamoto et al. | 347/86 |
| 6,834,945 | B2 * | 12/2004 | Ishizawa et al. | 347/86 |
| 7,753,501 | B2 | 7/2010 | Hatasa et al. | 347/84 |
| 8,529,037 | B2 * | 9/2013 | Miyashita et al. | 347/86 |
| 2004/0252146 | A1 | 12/2004 | Naka et al. | 347/6 |
| 2011/0205315 | A1 | 8/2011 | Saga et al. | 347/85 |
| 2012/0200647 | A1 | 8/2012 | Miyashita et al. | 347/86 |
| 2012/0300003 | A1 | 11/2012 | Takada et al. | 347/86 |

FOREIGN PATENT DOCUMENTS

| | | |
|---|---|---|
| EP | 1 462 263 | 9/2004 |
| JP | 11-320913 | 11/1999 |

(Continued)

OTHER PUBLICATIONS

U.S. Appl. No. 13/768,651, filed Feb. 15, 2013.

*Primary Examiner* — Anh T. N. Vo
(74) *Attorney, Agent, or Firm* — Fitzpatrick, Cella, Harper & Scinto

(57) ABSTRACT

A liquid container enables a liquid contained in a liquid containing chamber to be supplied to an exterior through a supply port. The liquid container includes a first channel, a second channel, and a communication path. The first channel is in communication with a first opening which opens into the liquid containing chamber. The second channel is in communication with a second opening which opens into the liquid containing chamber, the second opening being positioned above the first opening in a direction of gravitational force. The communication path allows the first channel and the second channel to communicate with each other outside the liquid containing chamber to permit a flow of the liquid.

19 Claims, 18 Drawing Sheets

(56) References Cited

FOREIGN PATENT DOCUMENTS

| | | |
|---|---|---|
| JP | 2000-211152 | 8/2000 |
| JP | 2004-306604 | 11/2004 |
| JP | 2006-102971 | 4/2006 |
| JP | 2008-188963 | 8/2008 |
| JP | 2011-079187 | 4/2011 |
| JP | 2011-173397 | 9/2011 |

* cited by examiner

LIQUID CONTAINER AND APPARATUS IN WHICH LIQUID CONTAINER IS MOUNTABLE

BACKGROUND OF THE INVENTION

1. Field of the Invention

The present invention relates to a liquid container which can contain various liquids and an apparatus in which the liquid container is mountable. In particular, the present invention relates to a liquid container which is preferably used as an ink tank containing pigment ink, and an apparatus in which the liquid container is mountable and which is preferably used as a printing apparatus printing images using the pigment ink fed from the ink tank.

2. Description of the Related Art

An exemplary supply system for a print head of an ink jet printing apparatus is configured such that an ink tank which accommodates ink is removably connected to a terminal of the supply system. Known removable ink tanks include those which hold ink using a capillary force generating member such as a sponge provided inside the tank and those which hold ink directly inside a flexible bag or a rigid housing. In particular, printers for graphic art such as posters involve a large amount of ink supplied per sheet and thus require a large ink capacity. Consequently, for these printers, ink tanks of a type which directly accommodates ink are desirable in view of the reduced replacement frequency and increased ink containment efficiency of these ink tanks.

Printed matter obtained using such a graphic art printer needs not only to provide high image quality but also to offer light resistance and gas resistance because the printed matter is sometimes posted outdoors. In general, dye ink offers only low light and gas resistance and thus has difficulty providing robust images. On the other hand, pigment ink containing pigment as a color material offers high light and gas resistance and can thus provide robust images. Thus, graphic art printers and the like have recently used pigment ink.

However, in the pigment ink, pigment particles float dispersedly without being dissolved into a solution. The thus floating pigment particles start to sink down in the direction of gravitational force due to their own weight as time elapses with the ink tank left stationary. Thus, in the pigment ink in the ink tank, a distribution of concentration of the pigment particles is formed, with the pigment concentration increasing downward in the direction of gravitational force and decreasing upward in the direction of gravitational force. If such a distribution of concentration of the pigment particles is formed, the pigment concentration of the pigment ink ejected from the print head changes during an initial stage and a last stage of supply of ink from the ink tank to the print head. Hence, printed images may be subjected to color differences or color unevenness and offer degraded color stability and color reproducibility.

To allow the pigment particles of the pigment ink to be uniformly dispersed, a method for stirring pigment ink has been proposed. Japanese Patent Laid-Open No. 2004-306604 describes a configuration which stirs ink contained in an ink containing chamber formed inside a flexible bag positioned in a tank case. Pressurized air is introduced into a closed space formed between an inner surface of the tank case and an outer surface of the flexible bag to collapse the flexible bag. Thus, the ink in the ink containing chamber is pressurized and fed through an ink supply port to an ink supply system on a printing apparatus side. An ink supply path is formed in the ink tank so as to allow the ink containing chamber to communicate with the ink supply port. The pressurized ink in the ink containing chamber is guided through the ink supply path to the ink supply port. The ink supply path includes a buffer chamber which expands when the ink in the ink containing chamber is pressurized and which contracts when the ink is depressurized. The expansion and contraction of the buffer chamber is utilized to stir the ink in the ink containing chamber. That is, when the ink containing chamber is pressurized, the ink is drawn from the ink containing chamber into the buffer chamber. Then, when the ink containing chamber is depressurized to return the ink in the buffer chamber to the ink containing chamber, the ink is stirred by an ink flow generated in the ink containing chamber.

However, according to the method for stirring ink using the buffer chamber provided in the ink supply path as disclosed in Japanese Patent Laid-Open No. 2004-306604, the stirring performance depends on the shape or configuration of the ink tank or a mounted orientation of the ink tank. This may preclude ink containing pigment from being efficiently stirred.

For example, if the ink containing chamber extends a long distance along the direction of gravitational force and the buffer chamber is provided in the ink supply path between the ink supply port and an opening positioned at the bottom of the ink containing chamber, then sufficient stirring performance cannot be provided when the volume of the buffer chamber decreases at a low speed. That is, the ink flow squirted from the buffer chamber through the ink supply port and the opening toward an inner upper part of the ink containing chamber loses force and may fail to reach the inner upper part of the ink containing chamber.

Furthermore, if the ink containing chamber is of a horizontal type, the opening in communication with the ink supply path is formed in an inner side surface of the ink containing chamber which extends in the vertical direction. Thus, ink squirted from the buffer chamber through the ink supply path and the opening into the ink containing chamber flows in the horizontal direction. However, the pigment concentration of the ink in the ink containing chamber varies in the direction of gravitational force, and thus ink with the pigment concentration of an ink area corresponding to the position of the opening is temporarily introduced into the ink supply path and then squirted into the ink containing chamber with ink with the same concentration present therein. That is, ink squirted horizontally through the opening is provided to ink with the same pigment concentration and fails to act positively on ink with different pigment concentrations. Additionally, such horizontal ink ejection also slightly spatters the ink in the direction of gravitational force but achieves stirring at a lower level than when the ink is ejected in the direction of gravitational force. The thus slightly spattered ink is unlikely to reach the inner upper part of the ink containing chamber if the opening formed in the side surface of the ink containing chamber is positioned closer to the bottom of the ink containing chamber. In addition, if the opening formed in the side surface of the ink containing chamber is positioned in the middle of the ink containing chamber in the direction of gravitational force, the ink squirted horizontally through the opening into the ink containing chamber is not high but average in pigment concentration. Thus, in particular, an ink area with a low pigment concentration which is present in the inner upper part of the ink containing chamber is difficult to stir efficiently.

Possible methods for increasing the efficiency at which the ink in the ink containing chamber is stirred include increasing the volume of the buffer chamber provided in the ink supply path, and increasing the spring constant of a spring member which biases the buffer chamber to augment the amount of ink squirted and the force of the squirt. However, the increased volume of the buffer chamber increases the size of the ink tank. Furthermore, the increased spring constant of the spring member biasing the buffer chamber increases a pressure applied to ink in order to expand the volume of the buffer chamber. This requires increased pressure of pressurized air introduced into the tank case in order to pressurize the ink in the ink containing chamber. This results in the need to improve the capabilities of a pressurization pump on the printing apparatus side configured to supply the pressurized air, leading to increased size and cost of the printing apparatus. Additionally, the increased ink pressure requires increased thickness of the tank case and increased strength of a welded portion provided to form a closed space in the tank case. This may increase the size and cost of the ink tank.

SUMMARY OF THE INVENTION

The present invention provides a liquid container and an apparatus in which the liquid container is mountable, the liquid container and the apparatus allowing a liquid to be efficiently stirred without depending on the shape of the liquid container or the mounted orientation of the liquid container or increasing the size or cost of the liquid container.

In the first aspect of the present invention, there is provided a liquid container enabling a liquid contained in a liquid containing chamber to be supplied to an exterior through a supply port, the liquid container comprising:

a first channel in communication with a first opening which opens into the liquid containing chamber;

a second channel in communication with a second opening which opens into the liquid containing chamber, the second opening being positioned above the first opening in a direction of gravitational force; and a communication path allowing the first channel and the second channel to communicate with each other outside the liquid containing chamber to permit a flow of the liquid.

In the second aspect of the present invention, there is provided an apparatus in which the above liquid container is mountable, the apparatus comprising:

a connection section configured to be connectable to the supply hole so as to allow introduction of the liquid in the liquid containing chamber; and a section configured to generate a flow of the liquid in the communication path.

In the third aspect of the present invention, there is provided an apparatus in which a liquid container comprising a liquid containing chamber with a liquid contained therein is mountable, the liquid containing chamber being formed at least partly of a flexible bag, wherein the liquid container comprises:

a first channel in communication with a first opening which opens into the liquid containing chamber;

a second channel in communication with a second opening which opens into the liquid containing chamber, the second opening being positioned above the first opening in a direction of gravitational force;

a supply hole communicating with an opening which opens into the liquid containing chamber to enable the liquid contained in the liquid containing chamber to be supplied to an exterior, the opening being positioned between the first opening and the second opening in the direction of gravitational force;

a communication path allowing the first channel and the second channel to communicate with each other outside the liquid containing chamber to permit a flow of the liquid;

a volume varying section capable of varying a volume of an internal space which is in communication with the communication path;

a valve regulating the flow of the liquid in the communication path to a direction from the first channel toward the second channel; and a displacement section configured to be displaced depending on a pressure in the communication path between the valve and the second opening; and the apparatus comprises:

a connection section configured to be connectable to the supply hole so as to allow introduction of the liquid in the liquid containing chamber; and a section configured to generate a flow of the liquid in the communication path.

The present invention includes the first and second openings opening into the liquid containing chamber so as to be misaligned with each other in the direction of gravitational force in the installed orientation of the liquid container. The present invention can thus generate a liquid flow which efficiently stirs the liquid in the ink containing chamber, through the communication path allowing the first and second openings to communicate with each other. That is, since the first and second openings are positioned so as to be misaligned with each other in the vertical direction, a vertical flow can be generated, through the channel, between a portion of the liquid located in the lower part of the liquid containing chamber and having a relatively high concentration and a portion of the liquid located in the upper part of the liquid containing chamber and having a relatively low concentration. Furthermore, besides the liquid supply path, the communication path is provided which allows the first and second openings opening into the liquid containing chamber to communicate with each other. Thus, a flow of the liquid which efficiently stirs the liquid in the ink containing chamber can be generated without depending on the pressure of the liquid in the supply path.

For example, in an ink tank containing, as a liquid, ink containing pigment, a lower portion of the ink having a high pigment concentration is drawn in through the first opening. The drawn-in ink is then guided, through the second opening, to an upper portion of the ink having a low pigment concentration. This allows the pigment ink to be efficiently stirred.

Further features of the present invention will become apparent from the following description of exemplary embodiments (with reference to the attached drawings).

DESCRIPTION OF THE EMBODIMENTS

Embodiments of the present invention will be described below in detail with reference to the drawings.

(First Embodiment)

FIG. 1 to FIG. 8 are diagrams illustrating a first embodiment of the present invention. The present embodiment will be described below for each of a plurality of items. Furthermore, the liquid container according to the present embodiment is an example of application of the present invention as an ink tank which accommodates ink and which is mountable in a printing apparatus.

(Ink Supply System)

Figure 1:
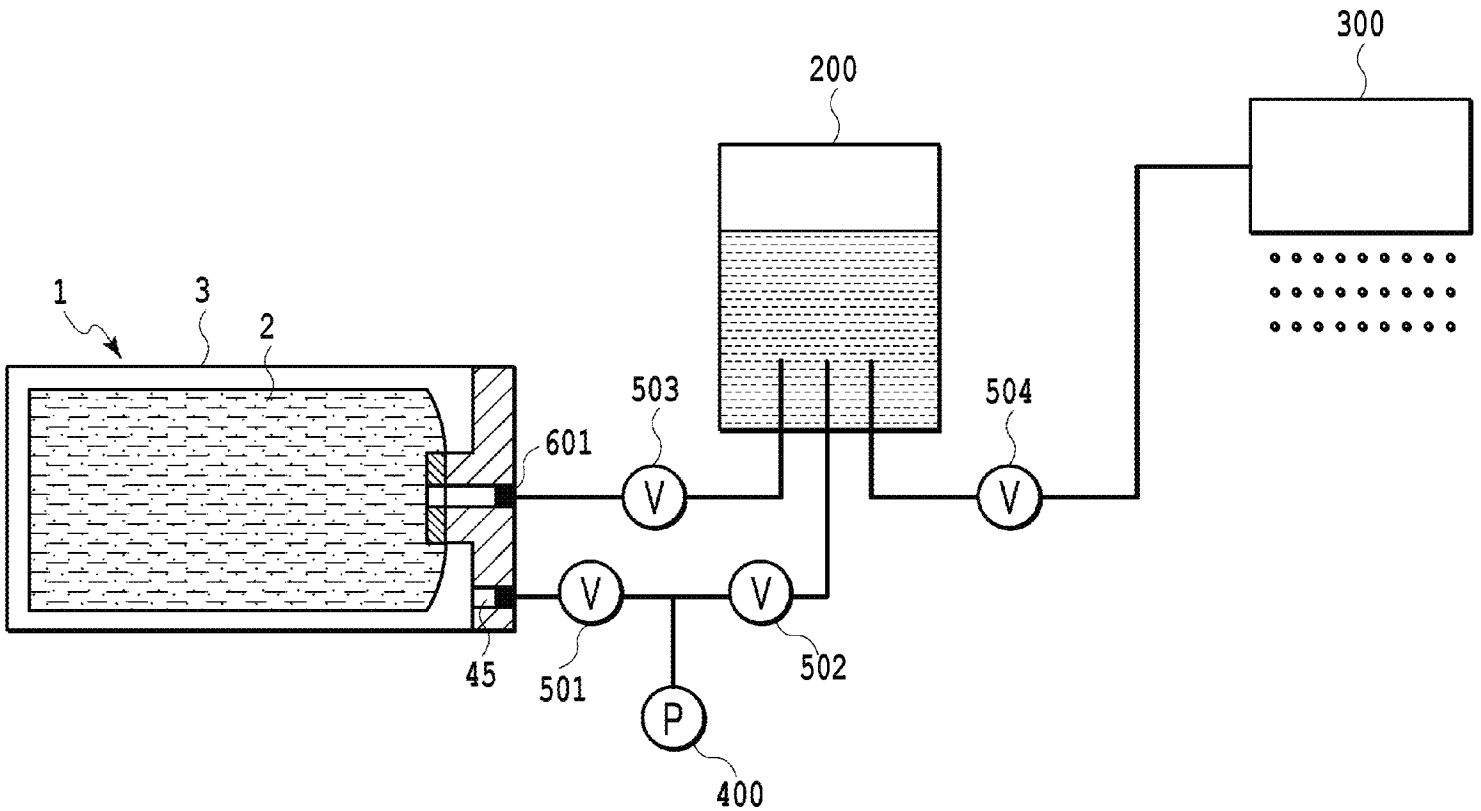
FIG. 1 is a schematic diagram of a configuration of an ink supply system in a printing apparatus in which an ink tank serving as a liquid container according to the present invention is mountable.

FIG. 1 is a schematic diagram of an ink supply system of a printing apparatus in which an ink tank 1 according to the present embodiment is mountable. Ink in the ink tank (ink containing chamber) 1 can be supplied to an ink jet print head 300 through a sub-tank 200. A power source for ink supply is compressed air from a pressurization pump 400 provided in the printing apparatus. As described below, the ink tank 1 and the sub-tank 200 are pressurized to allow ink to be supplied. A channel between the ink tank 1 and the sub-tank 200 and the print head 300 and the pressurization pump 400 includes valves 501, 502, 503, and 504 which can be controllably opened and closed in order to regulate the direction in which ink flows and to prevent a reverse flow of the ink. The print head 300 includes a negative pressure chamber (not shown in the drawings) configured to apply a predetermined negative pressure to ink fed from the sub-tank 200. The ink with the predetermined negative pressure applied thereto is ejected from a plurality of nozzles in the print head 300 in accordance with print data.

The ink jet print head 300 uses ejection energy generating elements such as electrothermal transducing elements (heaters) or piezo elements to eject ink through ejection ports at the tips of the nozzles. If electrothermal transducing elements are used, the electrothermal transducing elements generate heat to bubble ink so that the resultant bubbling energy can be utilized to eject the ink through the ejection ports at the tips of the nozzles. The printing apparatus includes a movement mechanism which moves the print head 300 and a print medium relative to each other. The printing apparatus prints an image on the print medium by allowing ink to be ejected from the nozzles in the print head 300 based on the print data. The printing apparatus may be based on any printing scheme such as a full line scheme or a serial scan scheme. The full line scheme uses a long print head to print an image by ejecting ink from the nozzles in the print head while continuously conveying the print medium in a direction intersecting with (for example, a direction orthogonal to) nozzle lines in the print head. The serial scan scheme prints an image by repeating an operation of ejecting ink from the nozzles while moving the print head in a main scanning direction and an operation of conveying the print medium in a sub-scanning direction intersecting with (for example, orthogonal to) the main scanning direction. The print head is not limited to the ink jet scheme of ejecting ink from the nozzles. Any print head may be used as long as the print head can apply ink to the print medium in order to print an image on the print medium.

(Method for Feeding Ink from the Ink Tank)

The ink tank 1 includes a tank case 3 and a flexible ink bag 2 positioned in the tank case 3. An ink containing chamber (liquid containing chamber) is formed inside the ink bag 2 to contain ink. Compressed air from the pressurization pump 400 is blown, through the valve 501 and a pressurization port 45 described below, into a closed space (pressurization chamber) formed between an inner surface of the tank case 3 and an outer surface of the ink bag 2 and into which pressure can be introduced. The blown-in compressed air collapses the ink bag 2 collapses the ink bag 2. An amount of ink corresponding to the collapsed volume is fed from inside the ink containing chamber (inside the liquid containing chamber) through the valve 503 to the sub-tank 200. Ink in the sub-tank 200 is fed to the print head 300 through the valve 504. In this manner, pressurizing the ink bag allows the ink in the ink containing chamber to be fed to the ink supply system on the printing apparatus side. The capability of feeding ink from the ink tank 1 improves depending on a pressure force on the ink bag 2. Thus, when an image is printed on a large-sized print medium such as a poster, even if the print head consumes a large amount of ink in a short time, an equivalent amount of ink can be supplied to the print head.

(Configuration of the Ink Tank)

Figure 2:
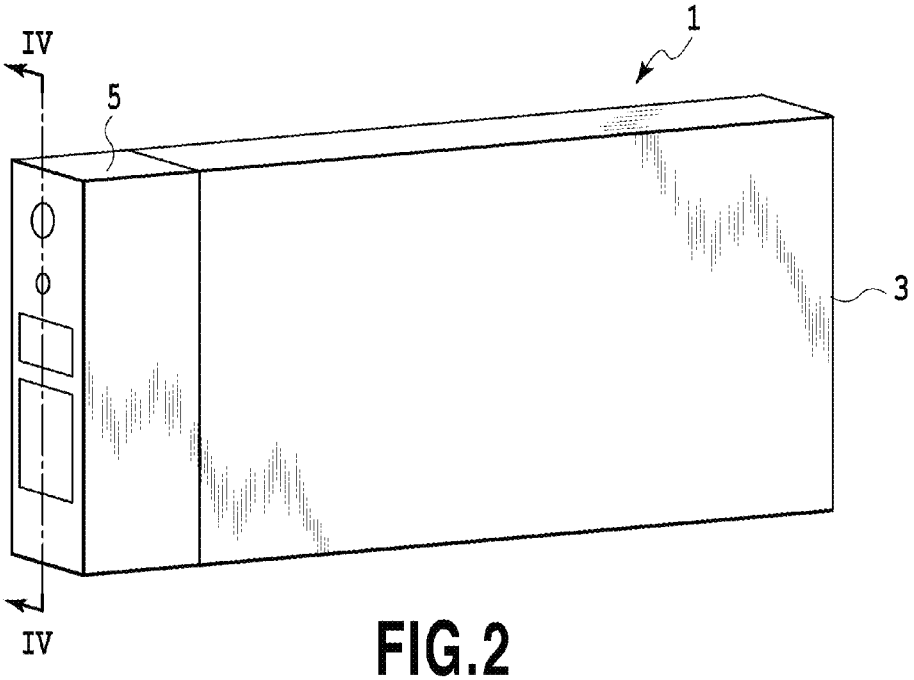
FIG. 2 is a perspective view of the appearance of an ink tank according to the first embodiment of the present invention.
Figure 3:
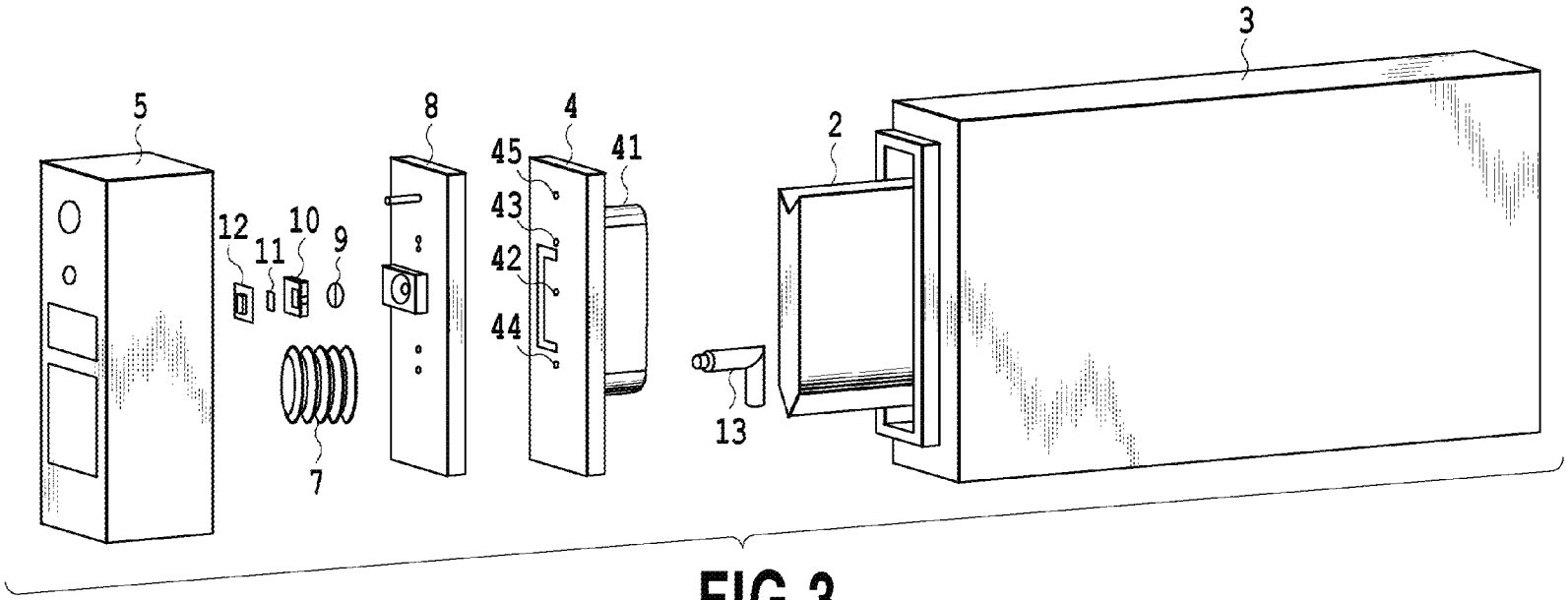
FIG. 3 is an exploded perspective view of the ink tank in FIG. 2.
Figure 4:
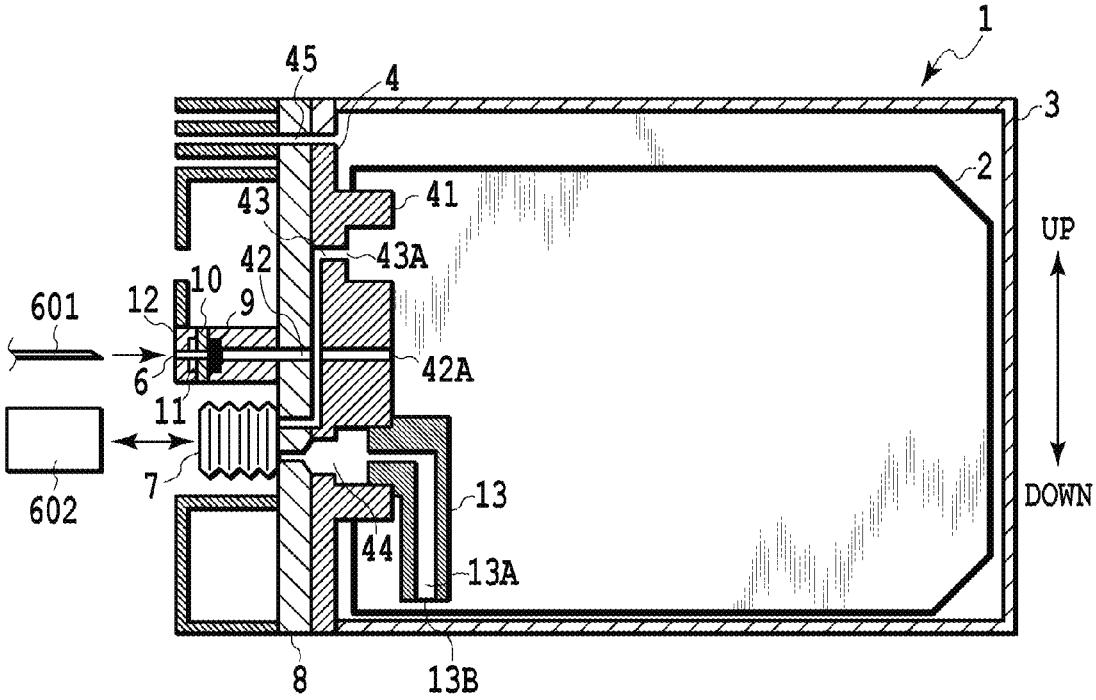
FIG. 4 is a cross-sectional view of the ink tank in FIG. 2 taken along line IV-IV.

Now, a configuration of the ink tank 1 will be described with reference to FIG. 2, FIG. 3, and FIG. 4. FIG. 2 is a diagram of the appearance of the ink tank 1. FIG. 3 is an exploded perspective view of the ink tank 1. FIG. 4 is a schematic cross-sectional view of the ink tank 1 taken along line IV-IV in FIG. 2.

The ink tank 1 includes the ink bag 2 which contains ink, the tank case 3 which encloses and protects the tank case 3, a channel forming member 4 which forms a channel in communication with the inside the of the ink bag 2, and a tank cover 5 which protects the channel forming member 4. A plurality of components are attached to the channel forming member 4 as described below.

(Ink Bag)

The ink bag 2 is formed of a deformable flexible material. The ink bag 2 allows the ink in the ink bag 2 to be supplied to an external component when pressurized by compressed air from the pressurization pump 400 in the printing apparatus main body. A desirable material for the ink bag 2 is a layer structure containing a flexible material allowing an easily collapsible bag to be formed, in order to allow the ink to be appropriately used up. An example of such a material is a sheet with a layer structure including a welded layer formed of polypropylene or polyethylene and a nylon film which improves impact resistance. Alternatively, a film with a layer structure partly formed of an aluminum sheet or a multilayer film including a vapor-deposited layer of silica or the like may be used in order to suppress evaporation of moisture in the ink.

According to the present embodiment, the ink bag 2 forms an ink containing chamber. This is because this configuration enables an installed orientation of the ink tank to be more freely selected, allowing the ink to be completely used up without depending on the position of an ink supply port 6.

(Channel Forming Member)

The channel forming member 4 includes a boat-shaped protruding portion 41. Sidewalls of the protruding portion 41 and an opening in the ink bag 2 are welded together to form an ink containing chamber which accommodates ink. An inner layer of the ink bag 2 and the channel forming member 4 are preferably formed of the same material, for example, polypropylene or polyethylene, and can thus be easily welded together. The protruding portion 41 includes a supply hole 42, a stirring hole (second channel) 43, and an intake hole 44 (first channel) all formed therein. The supply hole 42 allows an opening 42A which opens into the ink containing chamber to communicate with the ink supply port 6. The stirring hole 43 and the intake hole 44 allow a pump chamber 7 described below to communicate with an opening (second opening) 43A and an opening (first opening) 13B, respectively, which open into the ink containing chamber. The stirring hole 43 and the intake hole 44 are in communication with the pump chamber 7 through individual paths. The paths are formed by welding the channel forming member 4 and a plate member 8 together, and more specifically by blocking a groove formed in the channel forming member 4 with the plate member 8. In this manner, the communication path formed in the channel forming member 4 allows the intake hole 44 and the stirring hole 43 to communicate with each other outside the ink containing chamber. Ink is then permitted to flow between the intake hole 44 and the stirring hole 43. The pump chamber 7 is positioned in the communication path.

As shown in FIG. 4, in the installed orientation of the liquid container (ink tank 1), that is, in the orientation of the ink tank 1 installed in the printing apparatus main body, the opening (second opening) 43A of the stirring hole 43 is positioned, in the direction of gravitational force, above the opening (first opening) 13B of an extension member 13 described below which is in communication with the intake hole 44. In the direction of gravitational force, the opening 42A of the supply hole 42 is positioned between the opening 43A and the opening 13B. These positional relations are not necessarily limited to the orientation of the ink tank 1 installed in the printing apparatus main body. However, the positional relations are preferably established when the ink tank 1 is installed in the printing apparatus main body. Furthermore, the supply hole 42, stirring hole 43, and intake hole 44 in the present example are positioned on a side portion of the ink tank 1 which extends along the direction of gravitational force. In the channel forming member 4, a pressurization port 45 is formed in an area outside the protruding portion 41 so that compressed air from the pressurization pump 400 is introduced into the tank case 3 through the pressurization port 45. A welded rib (not shown in the drawings) is formed in the vicinity of an outer peripheral portion of the channel forming member 4. The tank case 3, formed of the same material as that of the welded rib, is welded to the welded rib to form a closed space into which compressed air flows.

(Ink Supply Port)

The ink supply port 6 in communication with the supply port 42 in the channel forming member 4 includes rubber 9, a rubber presser member 10, an absorber 11, and an absorber presser member 12. When the ink tank 1 is installed in an ink tank installation portion of the main body (apparatus main body) of the printing apparatus, a supply needle (connection section) 601 on the printing apparatus side is inserted into the ink supply port 6. Thus, the ink supply port 6 communicates with the sub-tank 200 through a hollow portion of the supply needle 601 and the valve 503. The rubber 9 and the supply needle 601 are sealed by the elastic force of the rubber 9. Furthermore, when the ink tank 1 is removed from the ink tank installation portion, ink seeping through the ink supply port 6 is absorbed by the absorber 11. This prevents contamination caused by the seeping ink. The connection section of the printing apparatus which can be connected to the ink supply port 6 is not limited to the form of the supply needle 601. Any component may be used provided that the component can be connected to the supply hole 42.

(Pump Chamber)

The ink in the ink bag 2 is stirred by a driving device 602 on the apparatus main body side pressing the pump chamber 7 as described below. The pump chamber 7 is formed of a bellows-shaped flexible member so that the volume of an internal space in the pump chamber forms a volume varying portion the volume of which varies. The driving device 602 on the apparatus main body side presses the pump chamber 7 to compress the bellows-shaped member, reducing the internal volume of the pump chamber 7. The driving device 602 on the apparatus main body side may be any device provided that the device can press the pump chamber 7, for example, a configuration which mechanically presses the pump chamber 7 using a cam or the like or a configuration which presses the pump chamber 7 using a cylinder operated by a pressurized fluid. Once the bellows-shaped member forming the pump member 7 is maximally compressed, the driving device 602 on the apparatus main body side releases the press force. Then, the shape restoring force of the pump chamber 7 itself acts to stretch and restore the bellows-shaped member to the original size. If the shape restoring force of the pump chamber 7 is so weak that a long time is required for the pump chamber 7 to return to the original size, a spring may be placed inside the pump chamber 7 to exert a restoring force. The compressing and restoring operations of the pump chamber 7 allow the ink in the ink bag 2 to be stirred as described below. Two openings are formed in the pump chamber 7. One of the openings is in communication with the stirring hole 43, and the other opening is in communication with the intake hole 44.

(Intake Channel)

The extension member 13, positioned in the ink bag 2, is attached to the intake hole 44. The intake hole 44 is in communication with the inside of the ink bag 2 through an intake channel 13A formed in the extension member 13. The intake channel 13A is formed to bend substantially perpendicularly from the intake hole 44 downward in the direction of gravitational force. The opening 13B of the intake channel 13A is positioned in the vicinity of the bottom of the ink bag 2, which corresponds to a lower side in the direction of gravitational force.

(Stirring Operation)

Figure 5:
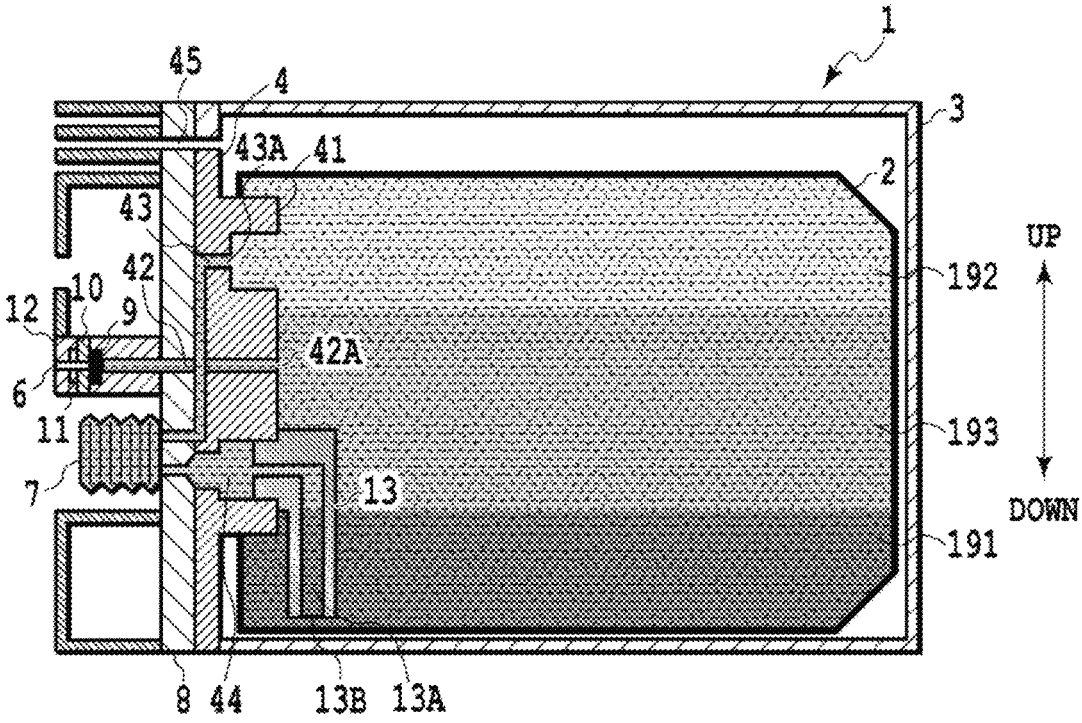
FIG. 5 is a cross-sectional view showing the state of the ink tank in FIG. 4 before a stirring operation.
Figure 6:
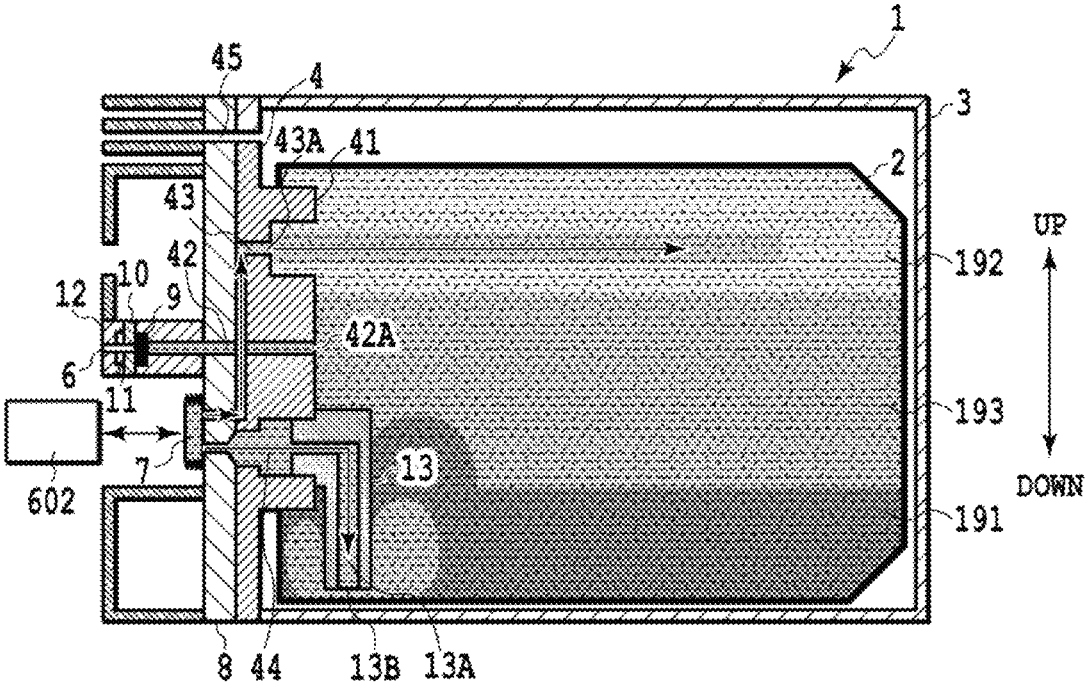
FIG. 6 is a cross-sectional view illustrating the stirring operation in the ink tank in FIG. 4.

FIG. 5 is a cross-sectional view showing the state of the ink tank 1 before an operation of stirring ink. FIG. 6 is a cross-sectional view showing that the driving device 602 on the apparatus main body side presses the pump chamber 7 to minimize the internal volume of the pump chamber 7.

As shown in FIG. 5, the ink tank 1 according to the present embodiment is installed in the apparatus main body in a horizontal orientation in which the channel forming member 4 is positioned at a side of the ink tank 1. When the ink accommodated in the ink bag 2 is pigment ink, if the ink tank 1 is left stationary in the mounted orientation (installed orientation) without being used for a long time, pigment particles in the pigment ink settles out. FIG. 5 schematically shows how the pigment particles settle out. An ink area 191 with a high pigment concentration is positioned on a lower side in the direction of gravitational force. Above the ink area 191, an ink area 193 with an average pigment concentration is positioned, and above the ink area 193, an ink area 192 with a low pigment concentration is positioned. A stirring operation is performed to make the concentration of the pigment particles uniform.

Ink is present in a stirring channel from the opening 13B of the intake channel 13A through the pump chamber 7 to the stirring hole 43. This is because during an ink injection step of a process of manufacturing an ink tank, the stirring channel in communication with the ink bag 2 is filled with ink so as to allow ink to be injected into the depressurized ink bag 2.

The operation stirring ink is performed by the driving device 602 on the apparatus main body side pressing the pump chamber 7 as shown in FIG. 6. When the pump chamber 7 is pressed, the bellows-shaped member forming the pump chamber 7 is contracted so as to be collapsed. The ink in the pump chamber 7 is accordingly pushed out by an amount equivalent to a decrease in the internal volume of the pump chamber 7. The pushed-out ink is squirted into the ink bag 2 through the opening 43A of the stirring hole 43 and the opening 13B of the intake channel 13A as shown by an arrow in FIG. 6.

Thereafter, the pressure exerted on the pump chamber 7 by the driving device 602 on the apparatus main body side is released to restore the pump chamber 7 to its original size. At this time, the internal volume of the pump chamber 7 increases to allow the pump chamber 7 to suck an amount of ink equivalent to the increase in internal volume. The ink in the ink bag 2 is drawn into the pump chamber 7 through the opening 13B of the intake channel 13A and the opening 43A of the stirring hole 43. At this time, the differential head of the ink causes the ink to be actively drawn into the pump chamber 7 through the opening 13B, positioned downward in the direction of gravitational force. Since the opening 13B is positioned in the ink area 191 with a high pigment concentration, ink with a pigment concentration higher than the average is drawn into the pump chamber 7.

Figure 7:
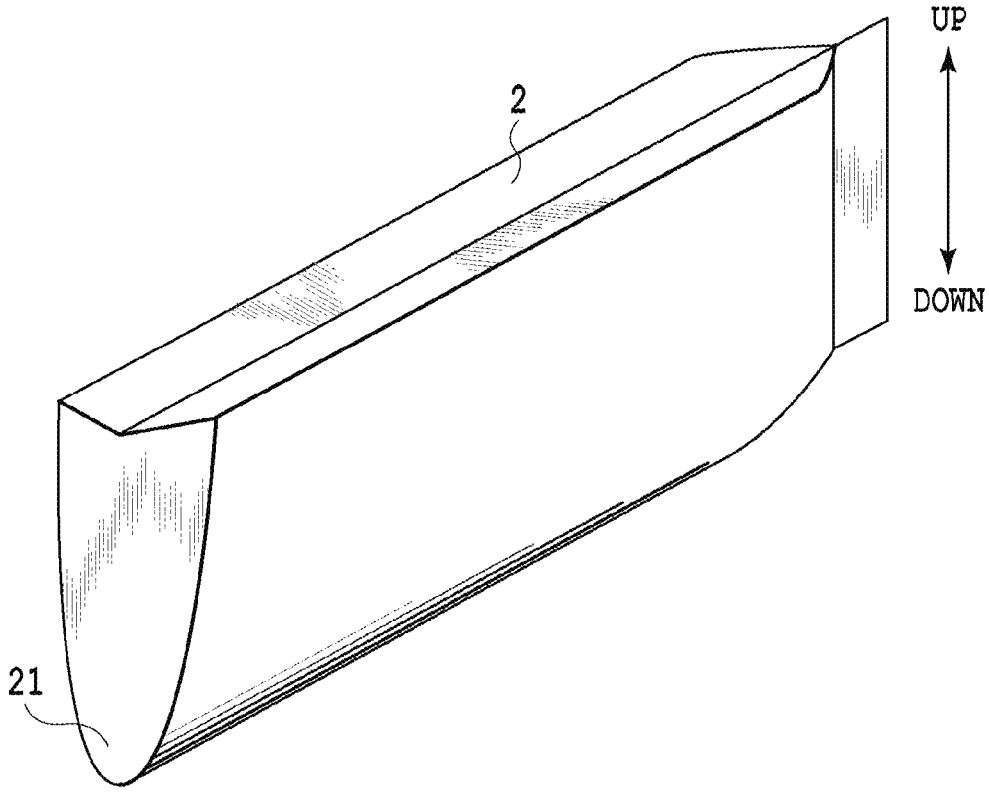
FIG. 7 is a perspective view showing the state of an ink bag in the ink tank in FIG. 2 before welding.
Figure 8:
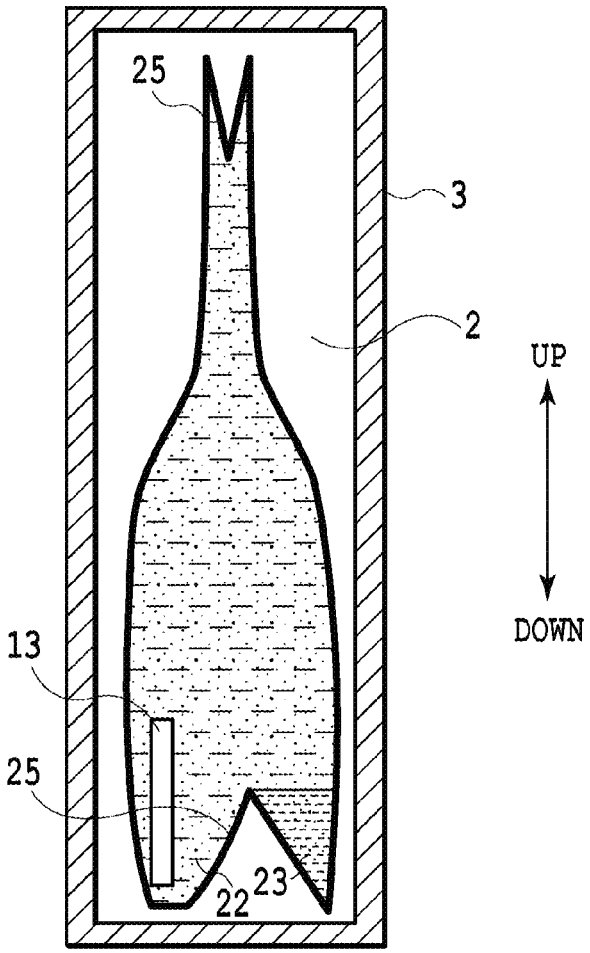
FIG. 8 is a cross-sectional view of an essential part of the ink tank illustrating a comparative example in which an ink bag of a gusset type is applied to the ink tank.

The ink bag 2 according to the present embodiment has a bag structure with one trough portion 21 formed on a bottom surface side as shown in FIG. 7. FIG. 7 is a perspective view of the ink bag 2 which has not been welded to the channel forming member 4. This bag structure allows a larger amount of ink with the pigment components thereof settled out to be drawn into the ink bag 2. For example, instead of the above-described bag structure, the ink bag 2 may have a bag structure with a gusset portion formed on the bottom surface as in the case of a gusset bag and two trough portions formed on the bottom surface side. However, in this case, a large amount of ink with the pigment components thereof settled out may remain in the ink bag. FIG. 8 illustrates that when the ink bag 2 is of a gusset type, the ink in the ink bag 2 is consumed with only a small amount of ink remaining therein. When the remaining amount of ink decreases as shown in FIG. 8, the gusset portion 25 positioned on the bottom surface side of the ink bag 2 stands up to form two trough portions 22 and 23. When the ink tank is left stationary for a long time and the pigment components in the ink settle out, the pigment components accumulate in both trough portions 22 and 23. In this case, the ink in the trough portion 22 in which the intake channel 13A is positioned can be drawn in and stirred, whereas the ink in the other trough portion 23 is difficult to draw in. Thus, in the final stage in which the ink in the ink bag 2 is used up, the concentrated ink in the other trough portion 23 is fed to the print head. As a result, color differences or color unevenness may occur in a print image.

Hence, according to the present embodiment, the ink bag 2 adopts a bag structure with one trough portion 21 formed in the bottom surface as shown in FIG. 7. On the other hand, a gusset bag with a gusset portion expands, when filled with ink, into a substantial rectangular parallelepiped along an inner surface of the tank case 3, and thus advantageously achieves a high ink containment efficiency. Thus, in order to improve ink draw-in performance and to suppress a decrease in ink containment efficiency, the present embodiment adopts a bag structure with a gusset portion provided on the upper side and one trough portion 21 formed on the bottom surface side.

As described above, the pump chamber 7 is subjected to a press force from the apparatus main body, and the ink in the pump chamber 7 is squirted into the ink bag 2 through the opening 43A of the stirring hole 43 and the opening 13B of the intake channel 13A. The opening 43A of the stirring hole 43 is positioned on an upper side in the direction of gravitational force so as to correspond to the ink area 192 with a low pigment concentration. The ink squirted through the opening 43A is the ink drawn into the pump chamber 7 and having a high pigment concentration. The ink with a high pigment concentration is squirted into the ink area 192 of the ink bag 2, which has a low pigment concentration. Furthermore, the ink in the pump chamber 7 is also squirted into the ink bag 2 through the opening 13B of the intake channel 13A. The opening 13B is positioned in the vicinity of the bottom surface of the ink bag 2 and opens toward the bottom surface side. Thus, a flow of the ink squirted through the opening 13B stirs up the ink in the ink area 191 having a high pigment concentration, in the direction of gravitational force. The stir-up of the ink reduces the amount of ink with a low pigment concentration from the ink area 19.

Such an operation of stirring ink is performed by repeating the operation of pressing and releasing the pump chamber 7. For example, if the ink bag has a capacity of 700 ml and the pump chamber has a volume of 5 ml, the ink in the ink bag is stirred so as to have an almost uniform pigment concentration by repeating the operation of pressing and releasing the pump chamber about twice to 30 times. Furthermore, according to the present embodiment, ink is contained in the ink containing chamber formed of the ink bag 2. However, ink may be accommodated directly in an ink containing chamber formed of a rigid housing. Also in this case, the stirring method as described above is applicable.

The above-described scheme of stirring ink allows ink to be stirred more efficiently than the conventional stirring method. Reasons for the efficient stirring of ink will be described below. A first reason is that ink with a high pigment concentration can be provided to the ink area 192 with a low pigment concentration, ensuring increased number of pigment particles in the ink area 192 with a low pigment concentration. A second reason is that ink can be stirred up by drawing in ink with a high pigment concentration though the opening 13B of the intake channel 13A and squirting the ink through the opening 13B again. That is, the stir-up of the ink enables the ink area 191 with a high pigment concentration settled out on the bottom surface to move upward in the direction of gravitational force. A third reason is that even if pigment particles settled out for a long time aggregate together into coarse particles, the coarse pigment particles can be crushed by ink flowing through the stirring channel extending through the pump chamber 7 and ink squirted into the ink bag 2. That is, the coarse pigment particles can be restored to the original size, thus improving ink stirring efficiency. For these reasons, ink can be reliably and efficiently stirred.

Furthermore, since ink can be efficiently stirred as described above, a sufficient stirring effect can be exerted even with the pump performance of the pump chamber 7. This enables a reduction in the size of the pump chamber and thus in the size and cost of the ink tank 1.

The ink tank 1 allows the thus stirred ink to be supplied to the printing apparatus, which can then use the ink, which has a uniform pigment concentration, to print a high-grade image. Furthermore, the opening 42A of the supply port 42 is positioned between the opening 43A of the stirring hole 43 and the opening 13B of the intake hole 44 in the direction of gravitational force. Thus, ink with an average pigment concentration can be fed from a vertically intermediate position in the ink bag 2 to the printing apparatus. Additionally, ink supplied to the printing apparatus through the opening 42A of the supply hole 42 is positioned between a flow of ink flowing into the opening (opening 13B) of the intake hole and a flow of ink squirted through the opening 43A of the stirring hole 43, and is thus sufficiently stirred.

(Second Embodiment)

Now, a second embodiment of the present invention will be described based on FIG. 9 to FIG. 11.

The ink tank 1 according to the present embodiment includes a one-way valve provided between the intake channel 13A and the intake hole 44 to regulate the flow of ink to one direction. Moreover, a diaphragm valve (displacement valve) 18 is provided in the channel between the stirring hole 43 and the pump chamber 7 to detect a flow of ink. The remaining part of the configuration of the ink tank 1 according to the present embodiment is similar to the corresponding part of the configuration of the first embodiment.

The configuration of the one-way valve 16 and the diaphragm valve 18 and the ink stirring operation will be described below.

(One-Way Valve)

Figure 10:
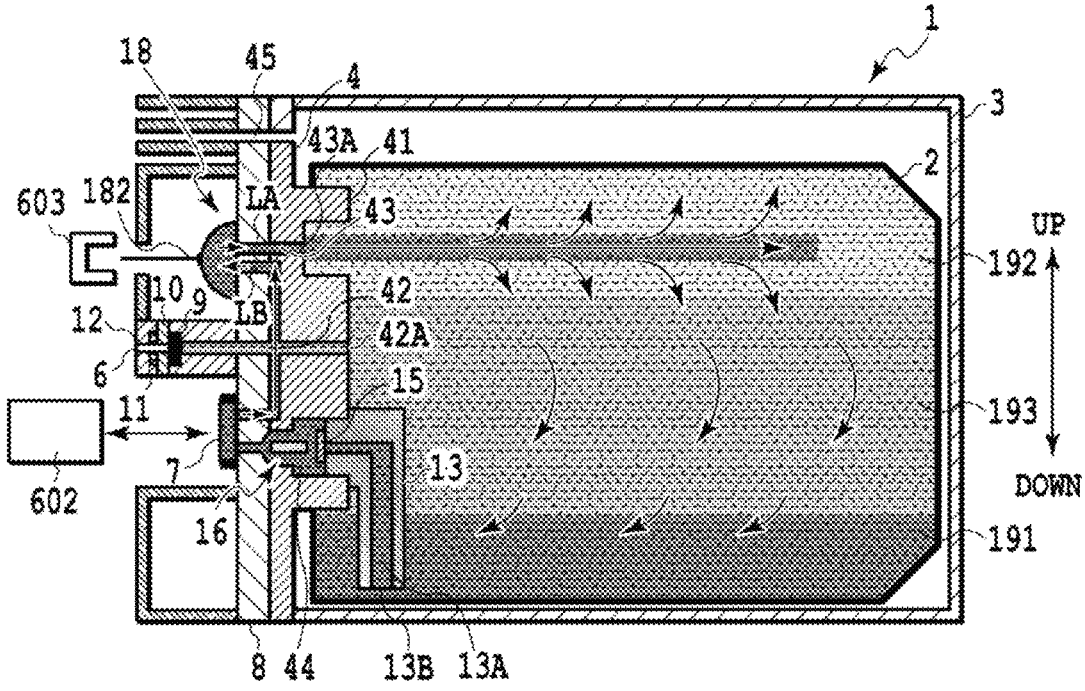
FIG. 10 is a cross-sectional view illustrating the stirring operation in the ink tank in FIG. 9.
Figure 11:
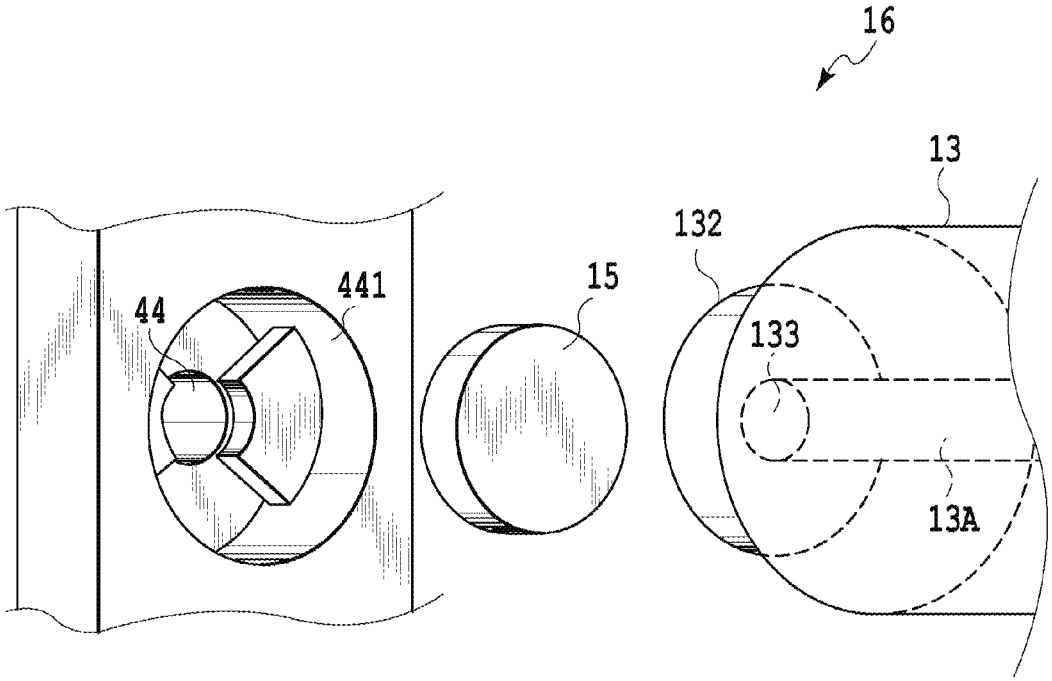
FIG. 11 is an exploded perspective view of a one-way valve in FIG. 9.

FIG. 11 is an enlarged exploded perspective view of the one-way valve 16. A disc-shaped circular disc member 15 is disposed between the intake hole 44 and the intake channel 13A. The disk member 15 functions as the valve disc of the one-way valve 16 which regulates the direction in which ink flows. The one-way valve 16 permits a flow of ink from inside the ink bag 2 toward the pump chamber 7 through the intake channel 13A, while inhibiting the opposite flow of ink. The intake hole 44 includes a recess portion 441 formed thereon and having a larger diameter than the disc member 15. A connection section 132 of the extension member 13 forming the intake channel 13A is pressed into the recess portion 441 to fix the extension member 13. A space is formed between a bottom surface of the recess portion 441 and the connection section 132 so that the disc member 15 is positioned in the space. The inner diameter of the recess portion 441 is larger than the outer diameter of the disc member 15, and thus the disc member 15 is freely movable through the space in the recess portion 441 in conjunction with movement of ink. The recess portion 441 includes a step formed on a bottom surface thereof. This ensures the flow of ink even when the disc member 15 sticks to the bottom surface of the recess portion 441. On the other hand, the inner diameter of the opening 133 at the connection section 132 of the intake channel 13A is smaller than the outer diameter of the disc member 15. Thus, as shown in FIG. 10, if the disc member 15 sticks to the opening 133 of the connection section 132, the opening 133 is blocked to close off the intake channel 13A. The one-way valve 16 uses the disc member 15, which functions as a valve disc as described above, to regulate the flow of ink to one direction.

(Diaphragm Valve)

The diaphragm valve 18 is formed of an elastic material such as rubber. As shown in FIG. 9, the diaphragm valve 18 is semicircular in cross section and includes a sunken portion 181 at the top thereof, with a column 182 extending upward from the sunken portion 181. The diaphragm valve 18 is arranged to separate the channel between the stirring hole 43 and the pump chamber 7 into two portions. The sunken portion 181 of the diaphragm valve 18 separates a stirring hole 43-side channel portion LA from a pump chamber 7-side channel portion LB. When the volume of the pump chamber 7 decreases to draw out the ink in the pump chamber 7, the ink in the pump chamber 7-side channel portion LB is pressurized. The pressurization expands the diaphragm valve 18 into a semicircular shape as shown in FIG. 10 to allow the channel portions LA and LB, separated from each other, to communicate with each other. At this time, the sunken portion 181 is raised leftward in FIG. 10, with the column 182 similarly raised. Thus, based on the displacement of the column 182, the flow of ink between the pump chamber 7 and the stirring hole 43 can be detected.

The apparatus main body includes a sensor (detection means) 603 configured to detect the displacement of the column 182. The sensor 603 in the present example is an optical sensor including a light emitting section and a light receiving section which are located opposite each other. Depending on the displacement of the column 182, an optical path is formed between the light emitting section and the light receiving section or the optical path is closed off. Thus, the displacement of the column 182 is detected. In the present example, when the diaphragm valve 18 is in such a normal state as shown in FIG. 9, the column 182 is not interposed between the light emitting section and the light receiving section. Thus, an optical path is formed between the light emitting section and the light receiving section, and the light receiving section receives light from the light emitting section. On the other hand, when the diaphragm valve 18 expands as shown in FIG. 10, the column 182 is interposed between the light emitting section and the light receiving section to close off the optical path between light emitting section and the light receiving section. Hence, the light receiving section receives no light from the light emitting section. Therefore, while ink is flowing from the pump chamber 7 toward the stirring hole 43, the diaphragm valve 18 expands to displace the column 182, blocking light from the light emitting section. The flow of the ink can then be detected.

Furthermore, the displacement of the diaphragm valve 18 may be visually or orally checked by the user. In this case, the user can be directly notified, without the use of the sensor 603 or the like, that ink is flowing from the pump chamber 7 toward the stirring hole 43.

(Stirring Operation)

As described above, the pump chamber 7 is collapsed so as to have a reduced internal volume, by the driving device 602 on the apparatus main body side. At this time, the one-way valve 16, provided in the intake hole 44, inhibits the flow of ink from the pump chamber 7 into the ink bag 2. The ink pushed out from the pump chamber 7 acts to flow toward the stirring hole 43. Typically, the channel between the pump chamber 7 and the stirring hole 43 is separated into the channel portions LA and LB by the diaphragm valve 18. However, the ink pushed out from the pump chamber 7 raises the pressure of the channel portion LB, and the pressure serves to push up the diaphragm valve 18 as shown in FIG. 10. Then, the channel portions LA and LB communicate with each other to allow the ink from the pump chamber 7 to flow toward the stirring hole 43. The ink having passed through the diaphragm valve 18 as described above is squirted into the ink bag 2 through the stirring hole 43 as shown by an arrow in FIG. 10.

Figure 9:
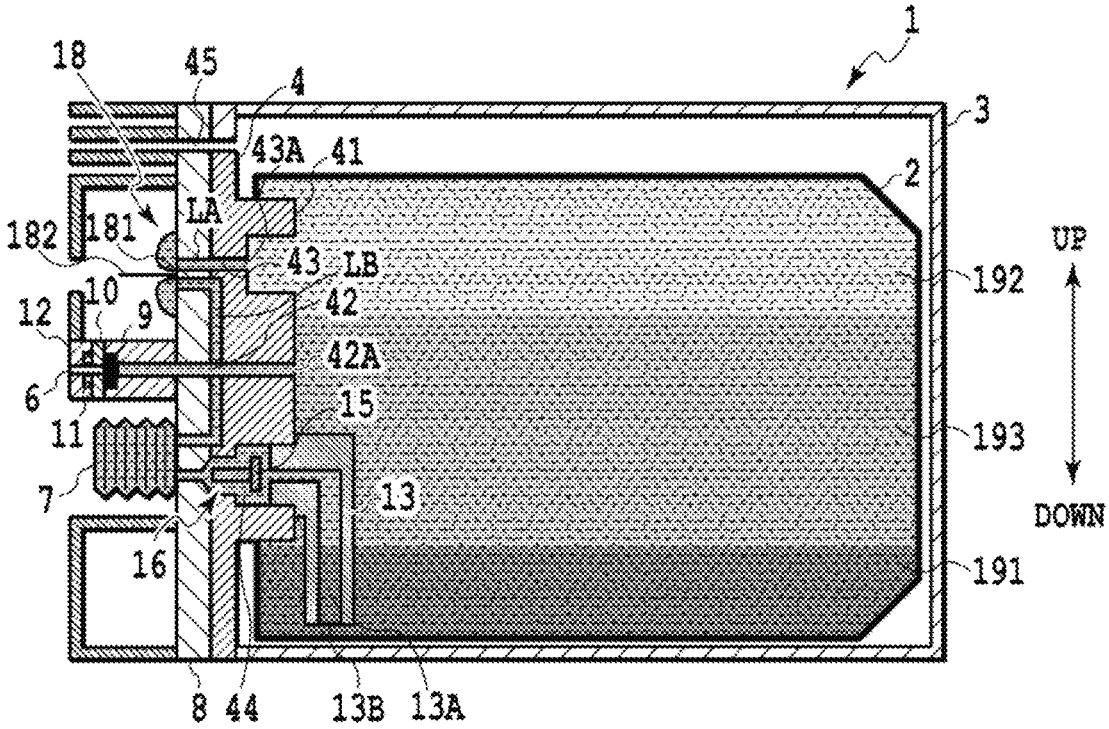
FIG. 9 is a cross-sectional view showing the state of an ink tank according to a second embodiment of the present invention before a stirring operation.

While ink is flowing through the channel portions LA and LB, the diaphragm valve 18 expands to displace the column 182 as shown in FIG. 10. The sensor 603 on the apparatus main body side can thus determine that ink is flowing as described above. After the squirt of ink from the pump chamber 7 into the ink bag 2 is completed, no ink flows through the channel portions LA and LB, and the pressure in the channel portion LA recovers to the original level. Thus, the diaphragm valve 18 recovers to the original state as shown in FIG. 9.

Reliable detection of a flow of ink is a reason for the disposition of the diaphragm valve 18, serving as a displacement section to cooperate with the sensor 603 in detecting a flow of ink, in the channel between the pump chamber 7 and the stirring hole 43. Such a displacement section or a sensor may be disposed on the pump chamber 7 side. However, if a liquid leaks from the pump chamber 7, which is repeatedly pressed, even when the internal volume of the pump chamber 7 is increased and reduced, the pump chamber 7 may simply repeat drawing in air from the outside of the ink tank and ejecting air to the outside of the ink tank. In this case, even though the pump chamber 7 is in operation, the ink is not stirred. Thus, the present embodiment provides the displacement section in the channel between the pump chamber 7 and the stirring hole 43 in order to reliably detect the stirring of the ink.

When the pressure on the driving device 602 on the apparatus main body side is released, the pump chamber 7 restores to the original size as shown in FIG. 9. At this time, the ink flowing from inside the ink bag 2 into the pump chamber 7 is positively drawn in through the opening 13B of the intake channel 13A, positioned downward in the direction of gravitational force, utilizing the differential head of ink. Since the present embodiment includes the diaphragm valve 18, the pressure in the channel portions LA and LB needs to be increased to or above a predetermined value in order to allow the channel portions LA and LB to communicate with each other. Thus, not much ink flows from the stirring hole 43 toward the pump chamber 7. That is, most of the ink is drawn into the pump chamber 7 through the intake channel 13, and ink with a higher pigment concentration than in the first embodiment enters the pump chamber 7. The ink is stirred by pressing the pump chamber 7 again to squirt the ink in the pump chamber 7 into the ink bag 2 through the stirring hole 43.

As described above, the present embodiment can draw ink with a higher pigment concentration than in the first embodiment into the pump chamber 7 and squirt the ink into the ink area 192 with a low pigment concentration. Thus, the ink can be more efficiently stirred. Furthermore, the present embodiment repeats such a stirring operation to enable generation of a flow of ink circulating extensively through the ink bag 2, thus stirring the ink throughout the ink bag 2. Additionally, the present embodiment detects the flow of ink contributing to ink stirring and can thus determine that ink stirring is being carried out.

(Third Embodiment)

Figure 12:
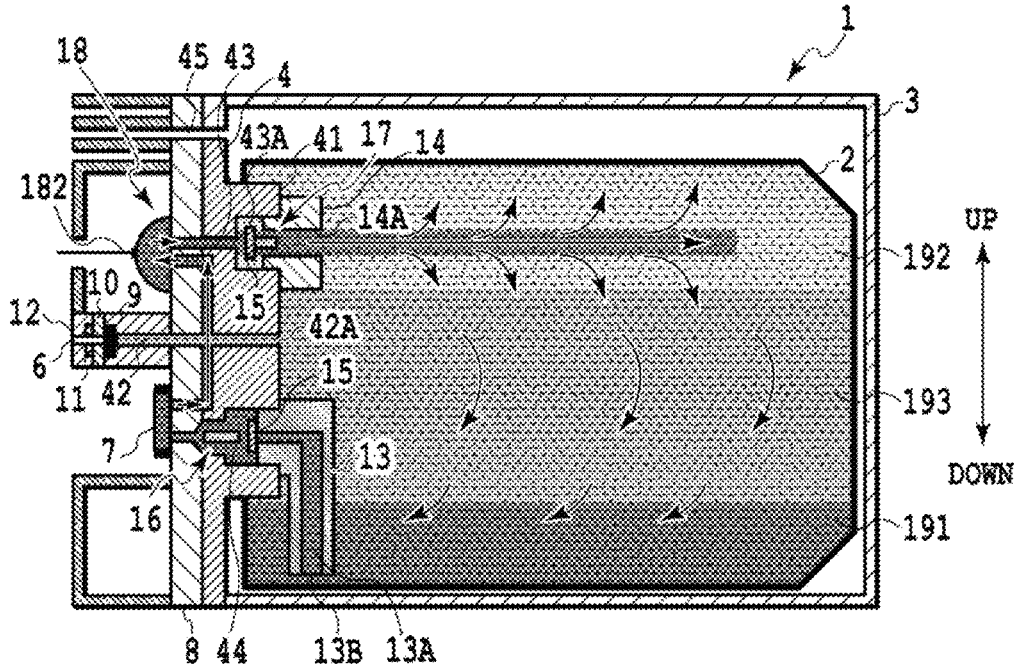
FIG. 12 is a cross-sectional view illustrating a stirring operation in an ink tank according to a third embodiment of the present invention.

As shown in FIG. 12, the ink tank 1 according to the present embodiment includes a one-way valve 17 in the stirring hole 43 in the ink tank according to the second embodiment, and is similar to the ink tank according to the embodiment in the other respects. The one-way valve 16 on the intake hole 44 side is hereinafter referred to as the "first one-way valve". The one-way valve 17 on the stirring hole 43 side is hereinafter referred to as the "second one-way valve". The second one-way valve 17 is configured similarly to the first one-way valve 16. The second one-way valve 17 includes the disc member 15 movably provided, as a valve disc, in the space between the stirring hole 43 and a cylindrical presser member 14 attached to the opening of the stirring hole 43. A step similar to the step of the recess portion 441 in FIG. 11 is formed in an opposite portion of the presser member 14 which lies opposite the disc member 15. This ensures a flow of ink from the stirring hole 43 into the ink bag 2 even if the disc member sticks to the opposite portion of the presser member 14. On the other hand, if the disc member 15 sticks to the opening of the stirring hole 43, the opening is blocked to inhibit the flow of ink from inside the ink bag 2 to the stirring hole 43. An opening 14A of the presser member 14 corresponds to the opening of the stirring hole 43, which opens into the ink bag 2.

The present embodiment includes the second one-way valve 17 on the stirring hole 43 side. Thus, when the collapsed pump chamber 7 recovers to the original size, ink flowing from inside the ink bag 2 into the pump chamber 7 all passes through the intake channel 13A. That is, all of the ink drawn into the pump chamber 7 forms an ink area 191 with a high pigment concentration. Hence, ink squirted through the stirring hole 43 as shown in FIG. 12 by collapsing the pump chamber 7 has a higher pigment concentration than in the second embodiment. This allows the ink to be more efficiently stirred.

(Fourth Embodiment)

Figure 13:
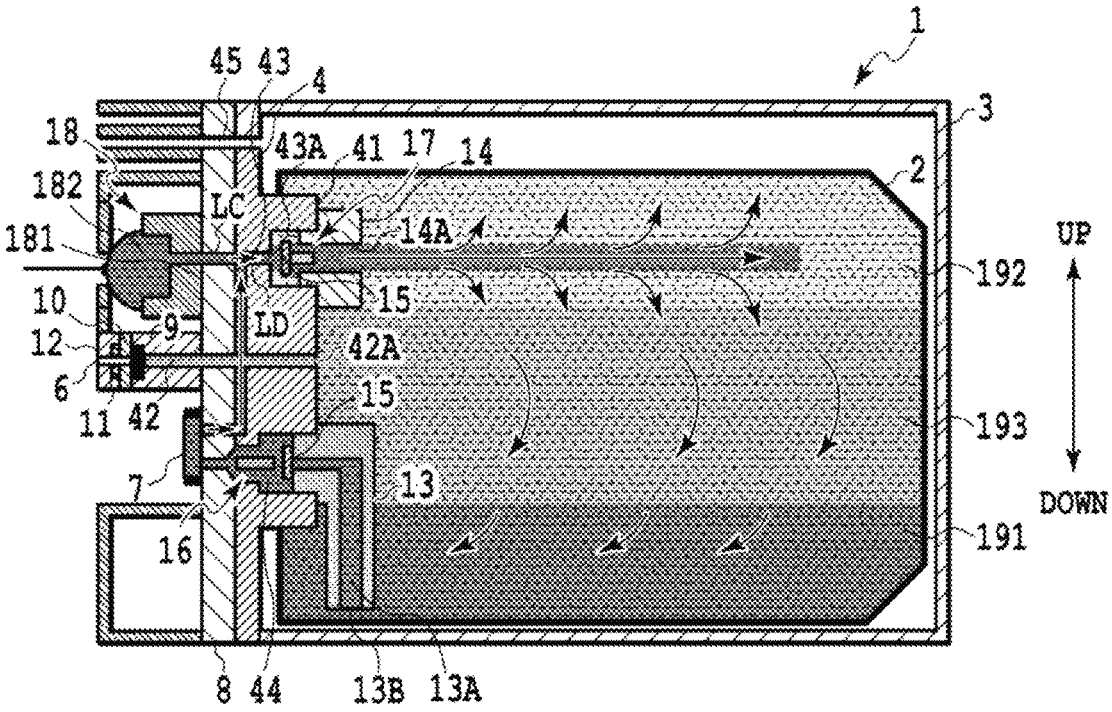
FIG. 13 is a cross-sectional view illustrating a stirring operation in an ink tank according to a fourth embodiment of the present invention.

As shown in FIG. 13, the ink rank 1 according to the present embodiment is different from the ink tank according to the third embodiment in the configuration of the channel from the pump chamber 7 to the stirring hole 43. The remaining part of configuration of the ink tank according to the present embodiment is similar to the remaining part of configuration of the ink tank according to the third embodiment. A stirring operation according to the present embodiment is also similar to the stirring operation according to the third embodiment. Thus, only effects of the different configuration of the channel will be described.

The channel for ink pushed out from the pump chamber 7 branches into a channel portion LC leading to the stirring hole 43 and a channel portion LD leading to the diaphragm valve 18. When the pump chamber 7 is collapsed to push out the ink inside the pump chamber 7, the pressure in the channel portions LC and LD increases. The first one-way valve 16 is provided on the intake hole 44 side, thus preventing the ink in the pump chamber 7 from flowing toward the intake hole 44. The diaphragm valve 18 is located at the far end of the channel portion LC, and thus an elevated pressure is reflected in the displacement of the diaphragm valve 18 but fails to allow ink to flow. Hence, as shown in FIG. 13, the ink in the ink bag 2 passes through the second one-way valve 17 and is then squirted into the bag 2 through the stirring hole 43. This allows the ink in the ink bag 2 to be stirred. Furthermore, as is the case with the third embodiment, the elevated pressure in the channel portions LC and LD pushes up the diaphragm valve 18 to displace the column 182. This displacement is detected by the sensor.

According to the present embodiment, the diaphragm valve 18 is disposed in the channel portion LC branching from the channel from the pump chamber 7 to the stirring hole 43. The position where the diaphragm valve 18 is disposed is not limited to the channel portion LC, which is in communication with the channel from the pump chamber 7 to the stirring hole 43. The diaphragm valve 18 may be disposed in any channel as long as the channel can be formed to communicate with the pump chamber 7. This accordingly enables an increase in the degree of freedom of selection of the position where the diaphragm valve 18 is disposed. For example, if the position where the sensor 603 is disposed on the apparatus main body side is limited, the channel in communication with the pump chamber 7 can be extended to a position corresponding to the position where the sensor 603 is disposed. The diaphragm valve 18 can then be disposed in the channel. This enables the diaphragm valve 18 to be disposed at the position corresponding to the sensor 603 to allow a flow of ink to be detected.

(Fifth Embodiment)

Figure 14:
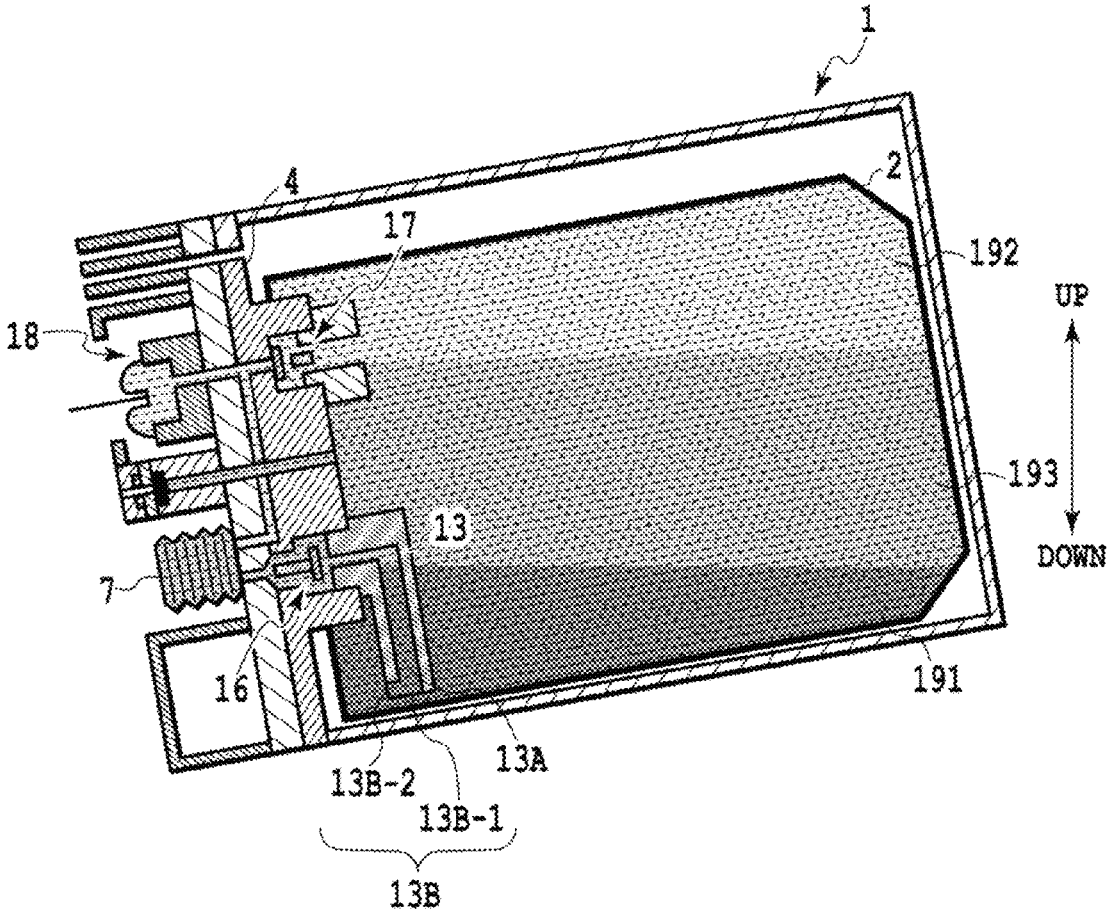
FIG. 14 is a cross-sectional view of an ink tank according to a fifth embodiment of the present invention.
Figure 15:
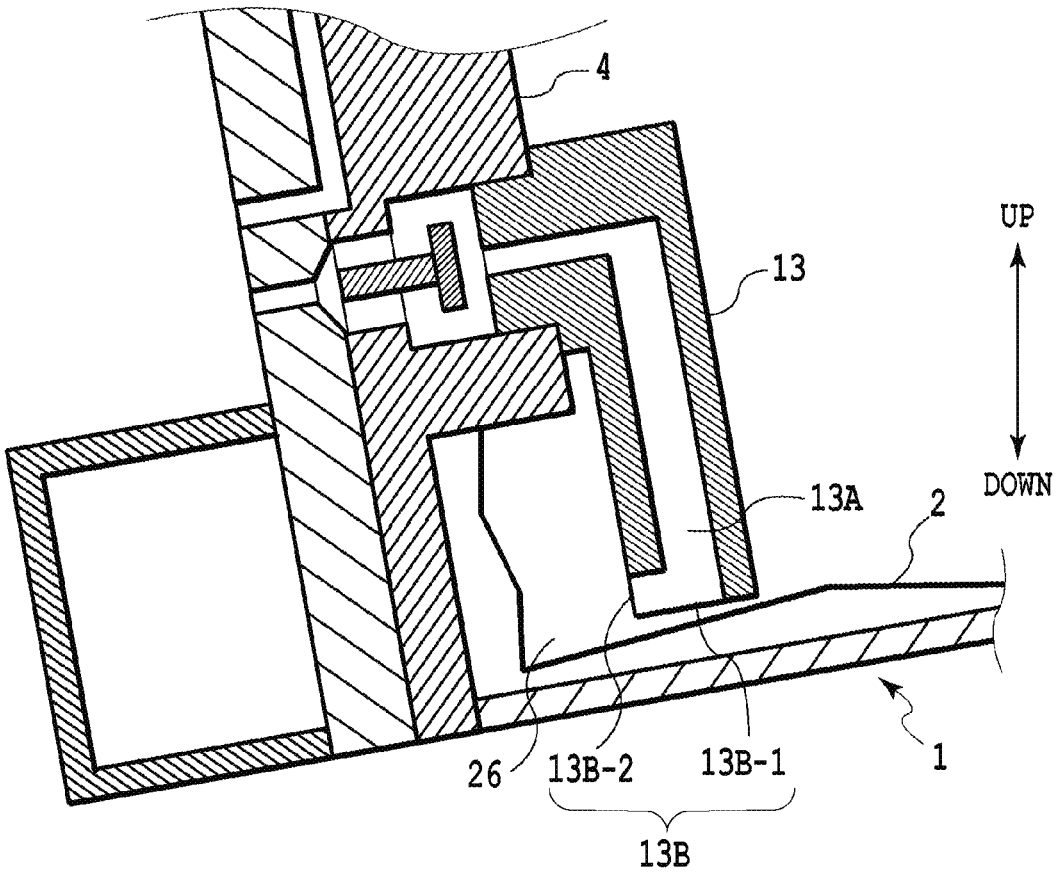
FIG. 15 is an enlarged cross-sectional view of the vicinity of an opening of an intake channel in the ink tank in FIG. 14.

FIG. 14 is a cross-sectional view of the ink tank 1 according to the present embodiment. FIG. 15 is an enlarged cross-sectional view of the opening 13B of the intake channel 13A in the ink tank 1. The ink tank 1 according to the present embodiment is different from the ink tank according to the fourth embodiment in the mounted orientation of the ink tank relative to the apparatus main body and in the shape of the opening 13B of the intake channel 13A. The remaining part of configuration of the ink tank 1 according to the present embodiment is similar to the remaining part of configuration of the ink tank according to the fourth embodiment. A stirring operation according to the present embodiment is also similar to the stirring operation according to the fourth embodiment. Thus, only effects of the above-described different configuration will be described.

As shown in FIG. 14, in the orientation of the ink tank 1 according to the present embodiment mounted in the apparatus main body, the ink tank 1 is inclined so that the channel forming member 4 side lies lower than the right side of the ink tank 1 in the direction of gravitational force. Such an inclined orientation causes the ink area 191 with a high pigment concentration which has settled out in the ink bag 2 to slide down toward the intake channel 13A. As shown in FIG. 14, the slid-down ink area 191 with a high pigment concentration is built up in the vicinity of the intake channel 13A. Thus, a larger amount of ink area 191 with a high pigment concentration can be drawn into the opening 13B of the intake channel 13A.

Furthermore, as shown in FIG. 15, the opening 13B of the intake channel 13A according to the present embodiment is formed not only in a surface of the extension member (the lower surface of the extension member in FIG. 15) lying opposite the bottom surface of the ink tank 1 but also in a surface of the extension member (the left surface of the extension member in FIG. 15) lying opposite the channel forming member 4. A portion of the opening 13B formed in the former surface is referred to as a first opening portion 13B-1. A portion of the opening 13B formed in the latter surface is referred to as a second opening portion 13B-2. If the mounted orientation of the ink tank 1 is inclined as shown in FIG. 14, the opening 13B formed to span the two surfaces as in the present example has a reduced distance to a lower corner portion 26 of the ink bag 2. Thus, the ink in the ink area 191 with a high pigment concentration which remains in the lower corner portion 26 can be more completely drawn into the opening 13B. Additionally, the opening 13B formed so as to span the two surface allows the ink in the ink bag 2 to be drawn into the opening 13B through the second opening portion 13B-2 even if a loosened portion of the ink bag 2 sticks to the first opening portion 13B. That is, a possible situation can be avoided where the loosened potion of the ink bag 2 blocks the opening 13B, that is, ink cannot be drawn into the opening 13B.

Thus, the present embodiment can draw in more of the ink in the ink area 191 with a high pigment concentration than the fourth embodiment. This allows ink stirring performance to be further improved. Furthermore, the present embodiment prevents the opening 13B from being blocked by the loosened portion of the ink bag 2. This allows the reliability of the ink stirring operation to be further improved.

(Sixth Embodiment)

Figure 16:
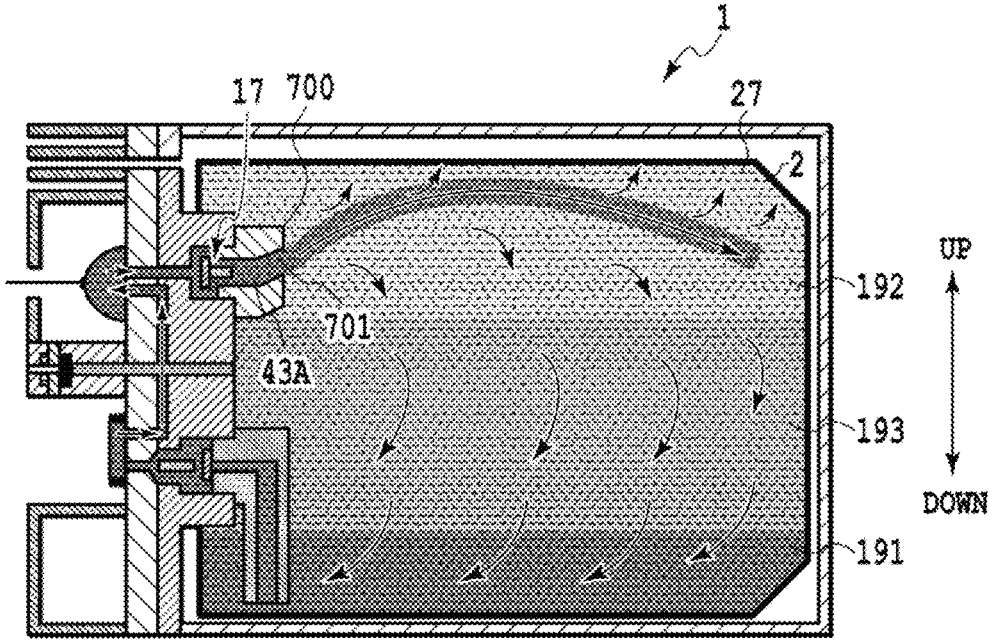
FIG. 16 is a cross-sectional view illustrating a stirring operation in an ink tank according to a sixth embodiment of the present invention.

In the ink tank 1 according to the present embodiment, instead of the presser member 14 (see FIG. 14), a nozzle member 700 also functioning as a presser member for the one-way valve 17 is attached to the stirring hole 43 a as shown in FIG. 16. The remaining part of configuration of the ink tank 1 according to the present embodiment is similar to the remaining part of configuration of the ink tank according to the third embodiment. Thus, only effects of the nozzle member 700 will be described.

The present embodiment is effective if the functions of the driving device 602 on the apparatus main body side are limited. For example, if the pump chamber 7 cannot be quickly pressed by the driving device 602, ink squirted through the stirring hole 43 may flow at a reduced flow velocity. The flow of the ink may fail to reach the right end, in FIG. 16, of the ink bag 2 and be stalled. In such a case, the ink in the ink area 191 with a high pigment concentration which is squirted through the stirring hole 43 fails to reach an inner upper corner 27 of the ink bag 2. The inner upper corner 27 remains at a low pigment concentration. Even when an ink stirring operation is repeated to generate a flow of ink circulating extensively through the ink bag 2, the ink positioned in the upper corner 27 is unlikely to be stirred because the upper corner 27 lies outside the flow of ink circulating in this manner. To allow the ink in the upper corner 27 to be stirred, the flow velocity of squirted ink needs to be increased to extend the distance over which the ink is squirted.

In view of such a situation, the present embodiment attaches the nozzle member 700 to the stirring hole 43. The nozzle member 700 has a squeezed shape with a cross sectional area gradually decreasing toward an ink bag 2-side opening 701 of the nozzle member 700. This enables an increase in the flow velocity of ink squirted from the nozzle member 700, allowing the ink to be squirted farther. Furthermore, the opening 701 of the nozzle member 700 is angled so as to face an obliquely upper right direction in FIG. 16. This inclination of the opening 701 allows a further increase in ink squirt distance, enabling the ink to reach the upper corner 27. The opening 701 of the nozzle member 700 corresponds to the opening of the stirring hole 43, which opens into the ink bag 2.

As described above, the present embodiment enables squirted ink to fly farther than the third embodiment. This allows the ink stirring performance to be further improved. Furthermore, the ink can be reliably stirred without depending strongly on the functions of the driving device 602 on the apparatus main body. The ink tank according to the present invention can be mounted in a small-sized, low-cost printing apparatus main body.

(Seventh Embodiment)

Figure 17:
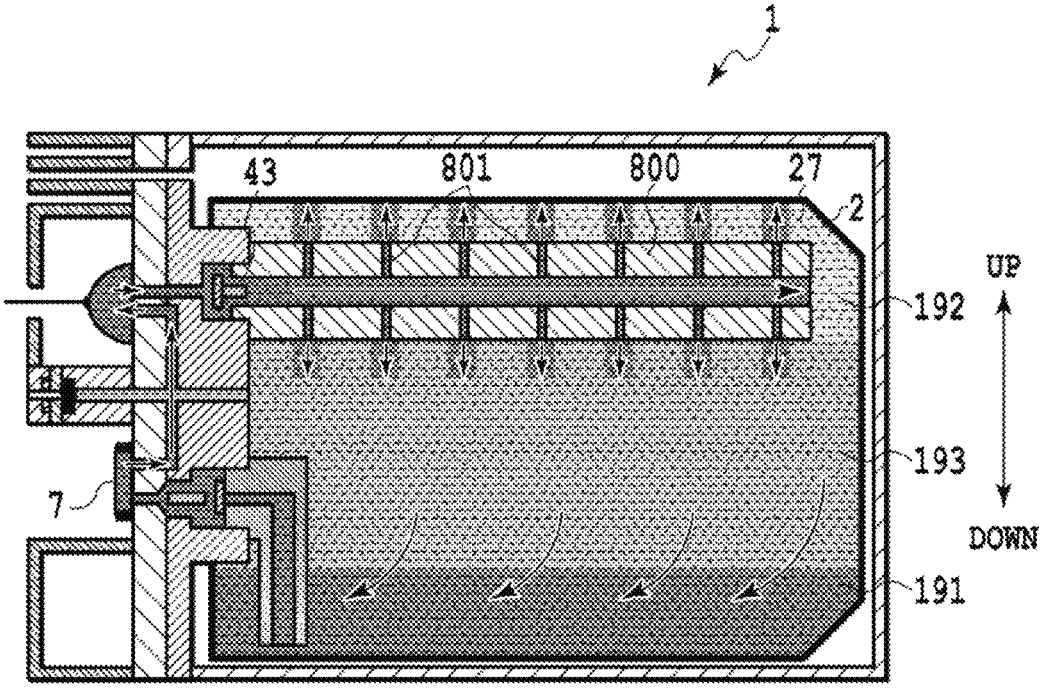
FIG. 17 is a cross-sectional view illustrating a stirring operation in an ink tank according to a seventh embodiment of the present invention.

In the ink tank 1 according to the present embodiment, instead of the presser member 14 according to the third embodiment (see FIG. 12), a pipe member 800 is attached to the stirring hole 43 a as shown in FIG. 17. The remaining part of configuration of the ink tank 1 according to the present embodiment is similar to the remaining part of configuration of the ink tank according to the third embodiment. Thus, only effects of the pipe member 800 will be described.

The pipe member 800 according to the present embodiment is hollow and extends from the stirring hole 43 in the horizontal direction. Portions of a wall of the pipe member 800 which are positioned in an upper side and a lower side, respectively, in the direction of gravitational force have a plurality of through-holes 801 formed therein. In an ink stirring operation, ink pushed out from the pump chamber 7 flows into the hollow portion of the pipe member 800 through the stirring hole 43. The ink is then squirted into the ink bag 2 through an opening at the tip of the pipe member 800. At this time, the ink is also squirted through the plurality of openings 801, positioned on the upper side and lower side in the direction of gravitational force. The velocity at which the ink passes through the pipe member 800 gradually decreases due to flow resistance. The ink squirt velocity decreases with increasing distance from the stirring hole 43. That is, the ink is forcefully squirted through the through-holes 801 located in the vicinity of the stirring hole 43. The amount of ink ejected through the through-holes 801 decreases with increasing distance from the through-hole 801 to the stirring hole 43.

In the pipe member 800 according to the present embodiment, the through-holes 801 positioned near the stirring hole 43 are set to have a smaller diameter, whereas the through-holes 801 positioned away from the stirring hole 43 are set to have a larger diameter. Thus, for ink squirted though the through-holes 801 positioned in the vicinity of the stirring hole 43, the amount of ink squirted through the through-holes 801 is suppressed due to strong resistance to which the ink is subjected upon passing through the through-holes 801. On the other hand, due to the larger diameter of the through-holes 801 positioned away from the stirring hole 43, the ink is subjected to weak resistance upon passing through the through-holes 801, and much ink can be squirted through the through-holes 801. Hence, in the longitudinal direction of the ink tank 1 (the lateral direction of FIG. 17), a uniform amount of ink can be spattered upward in the direction of gravitational force. Furthermore, adjustment of the diameter of the through-holes 801 enables the amount of ink spattered to be controlled for every plural areas in the ink bag 2, allowing positive stirring even of the ink in the inner upper corner 27 of the ink bag 2, in which stirring is difficult. The opening at the tip of the pipe member 800 and the through-holes 801 in the pipe member 800 correspond to the opening of the stirring hole 43, which opens into the ink bag 2.

(Eighth Embodiment)

Figure 18B:
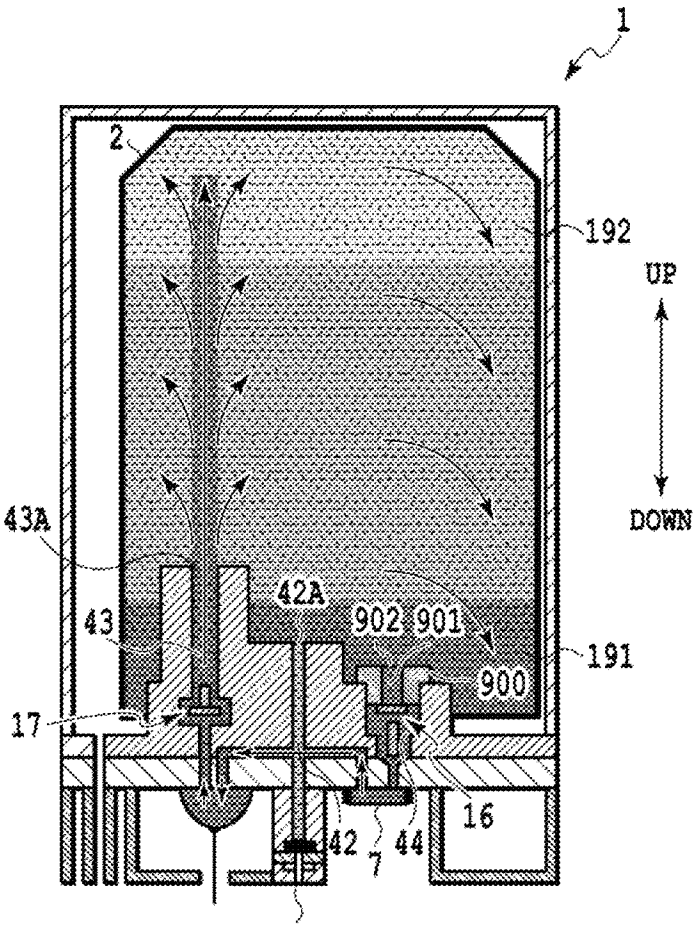
FIG. 18A and FIG. 18B are cross-sectional views illustrating an example of a different configuration of the ink tank according to the seventh embodiment of the present invention.
Figure 18A:
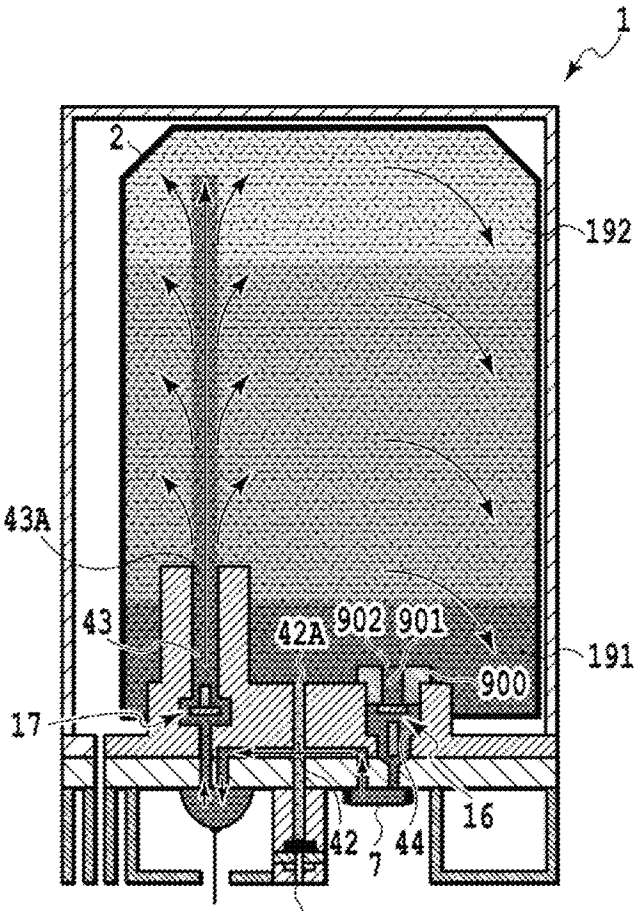

FIG. 18A and FIG. 18B are cross-sectional views illustrating an example of a different configuration of the ink tank 1 according to an eighth embodiment of the present invention. The eighth embodiment is basically similar to the third embodiment. However, the ink tank 1 according to the present embodiment is of a vertical type and is mounted in the apparatus main body so that the ink supply port 6 is located at the bottom as shown in FIG. 18A and FIG. 18B. A presser member 900 for the one-way valve 17 is attached to the intake hole 44. The intake hole 44 is in communication with the ink bag 2 through an intake channel 901 formed in the presser member 900. The opening 902 of the intake channel 901 opens upward in the direction of gravitational force. The opening 902 corresponds to the opening of the intake hole 44, which opens into the ink bag 2. The ink tank in FIG. 18A is different from the ink tank 1 in FIG. 18B in the positional relation between the opening 42A of the supply port 42 and the opening 43A of the stirring hole 43 and the opening 902 of the intake hole 44.

In the ink tank 1 in FIG. 18A and FIG. 18B, the opening 43A of the stirring hole 43 is positioned above the opening (opening 902) of the intake hole 44. Thus, ink squirted through the opening 43A of the stirring hole 43 reaches the ink area 192 with a low pigment concentration. The opening 43A of the stirring hole 43 is positioned above the opening 42A of the supply hole 42 and the opening (opening 902) of the intake channel 901 in the direction of gravitational force. In the ink tank 1 in FIG. 18A, the opening (opening 902) of the intake channel 901 is positioned, in the direction of gravitational force (height direction), between the opening 43A of the stirring hole 43 and the opening 42A of the supply hole 42. On the other hand, in the ink tank 1 in FIG. 18B, the opening 42A of the supply channel 42A is positioned between the opening 43A of the stirring hole 43 and the opening (opening 902) of the intake channel 901.

The present embodiment can also carry the ink in the ink area 191 with a high pigment concentration to the ink area 192 with a low pigment concentration. The present embodiment can further generate a flow of ink circulating throughout the ink bag 2. This allows the ink to be reliably and efficiently stirred.

(Other Embodiments)

The above-described embodiments use the pump chamber 7 operated by the driving device 602 on the apparatus main body side in order to generate a flow of ink in the communication path through which the stirring hole 43 and the intake hole 44 are in communication with each other. However, the configuration for generating a flow of ink in the communication path is not limited to the configuration using the pump chamber 7. For example, a configuration like a tube pump may be adopted in which the communication path is partly formed of a flexible tube which is squeezed by a roller or the like. In short, any configuration may be adopted which can cooperate with the driving device on the apparatus main body side in generating a flow of ink in the communication path.

Furthermore, the above-described embodiments adopt the pressurized supply scheme of supplying the ink in the ink tank to the printing apparatus by pressurizing the ink. However, a suction supply scheme may be adopted in which the printing apparatus side exerts a negative pressure in the ink tank to draw the ink in the ink tank to the printing apparatus side. In this case, ink can be supplied using the pressure difference between the ink supply system on the printing apparatus side and the inside of the ink tank, as is the case with the above-described embodiments. The ink tank can be configured as in the case of the above-described embodiments.

The present invention is widely applicable to various liquid containers containing liquids other than ink and is not limited to ink tanks containing ink. Furthermore, the present invention is applicable to various apparatuses in which the liquid container can be mounted, such as apparatuses using the liquid in the liquid container and apparatuses in which the liquid container is stored. The present invention is not limited to printing apparatuses.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application Nos. 2012-037657, filed Feb. 23, 2012 and 2013-010367, filed Jan. 23, 2013, which are hereby incorporated by reference herein in their entirety.

What is claimed is:

1. A liquid container enabling a liquid contained in a liquid containing chamber to be supplied to an exterior through a supply hole, the liquid container comprising:

a first channel in communication with a first opening which opens into the liquid containing chamber;

a second channel in communication with a second opening which opens into the liquid containing chamber, the second opening being positioned above the first opening in a direction of gravitational force;

a communication path allowing the first channel and the second channel to communicate with each other outside the liquid containing chamber to permit a flow of the liquid;

wherein the liquid containing chamber is formed at least partly of a flexible bag, and an opening of the supply hole opening into the liquid containing chamber is positioned between the first opening and the second opening in the direction of gravitational force.

2. The liquid container according to claim 1, further comprising a volume varying section capable of varying a volume of an internal space which is in communication with the communication path.

3. The liquid container according to claim 1, further comprising a valve regulating the flow of the liquid in the communication path to a direction from the first channel toward the second channel.

4. The liquid container according to claim 3, further comprising a displacement section configured to be displaced according to a pressure in the communication path between the valve and the second opening.

5. The liquid container according to claim 1, wherein the liquid containing chamber is formed at least partly of a flexible bag, an opening of the supply hole opening into the liquid containing chamber is positioned between the first opening and the second opening, and the liquid container further comprises:

a volume varying section capable of varying a volume of an internal space which is in communication with the communication path;

a displacement section configured to be displaced depending on a pressure in the communication path between the valve and the second opening; and a pressurization chamber capable of introducing a pressure acting to press the flexible bag so as to pressurize the liquid in the liquid containing chamber.

6. The liquid container according to claim 1, wherein the supply hole is positioned on a side of the liquid containing chamber extending along the direction of gravitational force in an installed orientation of the liquid container.

7. The liquid container according to claim 1, wherein the supply hole is positioned at a bottom of the liquid containing chamber in the direction of gravitational force in an installed orientation of the liquid container in a printing apparatus.

8. The liquid container according to claim 1, wherein the second opening is positioned above the first opening in the direction of gravitational force in an installed orientation of the liquid container in a printing apparatus.

9. The liquid container according to claim 1, wherein the second opening is an opening through which ink drawn into the first channel through the first opening is squirted into the liquid containing chamber.

10. The liquid container according to claim 1, wherein the liquid is ink containing pigment.

11. An apparatus in which the liquid container according to claim 1 is mountable, the apparatus comprising:

a connection section configured to be connectable to the supply hole so as to allow introduction of the liquid in the liquid containing chamber; and a section configured to generate a flow of the liquid in the communication path.

12. The liquid container according to claim 1, wherein the second opening is positioned above the first opening in the direction of gravitational force in an installed orientation of the liquid container in a printing apparatus main body.

13. The liquid container according to claim 1, wherein the opening of the supply hole is positioned between the first opening and the second opening in the direction of gravitational force in an installed orientation of the liquid container in a printing apparatus main body.

14. The liquid container according to claim 13, wherein the second opening is positioned above the first opening in the direction of gravitational force in the installed orientation of the liquid container in the printing apparatus main body.

15. An apparatus in which a liquid container comprising a liquid containing chamber with a liquid contained therein is mountable, the liquid containing chamber being formed at least partly of a flexible bag, wherein the liquid container comprises:

a first channel in communication with a first opening which opens into the liquid containing chamber;

a second channel in communication with a second opening which opens into the liquid containing chamber, the second opening being positioned above the first opening in a direction of gravitational force;

a supply hole communicating with an opening which opens into the liquid containing chamber to enable the liquid contained in the liquid containing chamber to be supplied to an exterior, the opening being positioned between the first opening and the second opening in the direction of gravitational force;

a communication path allowing the first channel and the second channel to communicate with each other outside the liquid containing chamber to permit a flow of the liquid;

a volume varying section capable of varying a volume of an internal space which is in communication with the communication path;

a valve regulating the flow of the liquid in the communication path to a direction from the first channel toward the second channel; and a displacement section configured to be displaced depending on a pressure in the communication path between the valve and the second opening; and the apparatus comprises:

a connection section configured to be connectable to the supply hole so as to allow introduction of the liquid in the liquid containing chamber; and a section configured to generate a flow of the liquid in the communication path.

16. The apparatus according to claim 15, further comprising a detection section configured to detect displacement of the displacement section.

17. The apparatus according to claim 16, wherein the opening of the supply hole is positioned between the first opening and the second opening in the direction of gravitational force in an installed orientation of the liquid container in a printing apparatus main body.

18. The apparatus according to claim 15, wherein the second opening is positioned above the first opening in the direction of gravitational force in an installed orientation of the liquid container in a printing apparatus main body.

19. The apparatus according to claim 15, wherein the opening of the supply hole is positioned between the first opening and the second opening in the direction of gravitational force in an installed orientation of the liquid container in a printing apparatus main body.

* * * * *